US010183785B2

(12) United States Patent
McGuire et al.

(10) Patent No.: US 10,183,785 B2
(45) Date of Patent: Jan. 22, 2019

(54) FLEXIBLE CONTAINERS WITH VENTING STRUCTURE

(71) Applicant: The Procter & Gamble Company, Cincinnati, OH (US)

(72) Inventors: Kenneth Stephen McGuire, Montgomery, OH (US); Jun You, West Chester, OH (US); Lee Mathew Arent, Fairfield, OH (US)

(73) Assignee: The Proctor & Gamble Company, Cincinnati, OH (US)

( * ) Notice: Subject to any disclaimer, the term of this patent is extended or adjusted under 35 U.S.C. 154(b) by 78 days.

(21) Appl. No.: 15/466,901

(22) Filed: Mar. 23, 2017

(65) Prior Publication Data

US 2017/0305609 A1 Oct. 26, 2017

Related U.S. Application Data

(60) Provisional application No. 62/327,633, filed on Apr. 26, 2016.

(51) Int. Cl.

| | |
|---|---|
| ***B65D 35/08*** | (2006.01) |
| ***B65D 35/14*** | (2006.01) |
| ***B65D 35/46*** | (2006.01) |
| ***B65D 75/00*** | (2006.01) |
| ***B65D 75/30*** | (2006.01) |
| ***B65D 75/58*** | (2006.01) |
| ***B65D 77/22*** | (2006.01) |

(52) U.S. Cl.

CPC ..... *B65D 35/14* (2013.01); *B65D 35/08* (2013.01); *B65D 35/46* (2013.01); *B65D 75/008* (2013.01); *B65D 75/30* (2013.01); *B65D 75/5811* (2013.01); *B65D 77/225* (2013.01)

(58) Field of Classification Search

CPC ..... B75D 75/30; B75D 75/5811; B75D 75/5822; B75D 77/225

USPC ..... 222/213

See application file for complete search history.

(56) References Cited

U.S. PATENT DOCUMENTS

| | | | | |
|---|---|---|---|---|
| 2,696,342 | A * | 12/1954 | Toborg | F16K 15/202 128/DIG. 24 |
| RE24,251 | E | 12/1956 | Kaplan et al. | |
| 3,009,498 | A | 11/1961 | Matthias | |
| 3,155,282 | A * | 11/1964 | LeBlanc | B65D 75/5811 206/484 |
| 3,184,121 | A | 5/1965 | Volckening | |
| 4,044,867 | A | 8/1977 | Fisher | |
| 4,717,046 | A * | 1/1988 | Brogli | B65D 75/20 206/484 |
| 4,792,060 | A | 12/1988 | Brogli | |

(Continued)

FOREIGN PATENT DOCUMENTS

| | | |
|---|---|---|
| CN | 1640777 | 7/2005 |
| DE | 102005002301 | 7/2006 |

(Continued)

OTHER PUBLICATIONS

International Search Report dated Jun. 22, 2017, U.S. Appl. No. 15/466,901, 14 pages.

(Continued)

*Primary Examiner* — Jeremy Carroll
(74) *Attorney, Agent, or Firm* — David M Weirich

(57) ABSTRACT

Flexible containers with structural support frames including dispensing and venting structures.

19 Claims, 16 Drawing Sheets

(56) References Cited

U.S. PATENT DOCUMENTS

| | | | | |
|---|---|---|---|---|
| 4,949,530 | A | 8/1990 | Pharo | |
| 4,988,016 | A * | 1/1991 | Hawkins | B65D 75/30 222/107 |
| 5,137,154 | A | 8/1992 | Cohen | |
| 5,960,975 | A | 10/1999 | Lenartsson | |
| 6,244,466 | B1 | 6/2001 | Naslund | |
| 6,667,081 | B1 * | 12/2003 | Aoki | B65D 75/5805 206/218 |
| 7,207,717 | B2 | 7/2007 | Steele | |
| 8,181,428 | B2 | 5/2012 | Gustafsson | |
| 8,661,772 | B2 | 3/2014 | Yasuhira | |
| 8,662,751 | B2 | 3/2014 | Forss | |
| 9,327,867 | B2 | 5/2016 | Stanley et al. | |
| 9,586,744 | B2 | 3/2017 | Arent et al. | |
| 2003/0094394 | A1 | 5/2003 | Anderson et al. | |
| 2004/0035865 | A1 | 2/2004 | Rosen | |
| 2004/0118859 | A1 | 6/2004 | Stefandl | |
| 2005/0126941 | A1 | 6/2005 | Ferri | |
| 2009/0060398 | A1 * | 3/2009 | Kawakami | B65D 75/5822 383/93 |
| 2009/0129706 | A1 * | 5/2009 | Otsuka | B65D 75/5822 383/42 |
| 2010/0308062 | A1 | 12/2010 | Helou | |
| 2012/0097634 | A1 | 4/2012 | Riedl | |
| 2013/0292287 | A1 | 11/2013 | Stanley et al. | |
| 2013/0292353 | A1 | 11/2013 | Stanley et al. | |
| 2013/0292395 | A1 | 11/2013 | Stanley et al. | |
| 2013/0292413 | A1 | 11/2013 | Stanley et al. | |
| 2013/0292415 | A1 | 11/2013 | Stanley et al. | |
| 2013/0294711 | A1 | 11/2013 | Stanley et al. | |
| 2013/0337244 | A1 | 12/2013 | Stanley et al. | |
| 2014/0033654 | A1 | 2/2014 | Stanley et al. | |
| 2014/0033655 | A1 | 2/2014 | Stanley et al. | |
| 2014/0250834 | A1 | 9/2014 | Yoshikane et al. | |
| 2015/0028057 | A1 | 1/2015 | Arent et al. | |
| 2015/0033671 | A1 | 2/2015 | Stanley et al. | |
| 2015/0034670 | A1 | 2/2015 | Stanley et al. | |
| 2015/0036950 | A1 | 2/2015 | Stanley et al. | |
| 2015/0121810 | A1 | 5/2015 | Bourgeois et al. | |
| 2015/0122373 | A1 | 5/2015 | Bourgeois et al. | |
| 2015/0122840 | A1 | 5/2015 | Cox et al. | |
| 2015/0122841 | A1 | 5/2015 | McGuire et al. | |
| 2015/0122842 | A1 | 5/2015 | Berg et al. | |
| 2015/0122846 | A1 | 5/2015 | Stanley et al. | |
| 2015/0125099 | A1 | 5/2015 | Ishihara et al. | |
| 2015/0125574 | A1 | 5/2015 | Arent et al. | |
| 2015/0126349 | A1 | 5/2015 | Ishihara et al. | |
| 2016/0176578 | A1 | 6/2016 | Stanley et al. | |
| 2016/0176582 | A1 | 6/2016 | McGuire et al. | |
| 2016/0176583 | A1 | 6/2016 | Ishihara et al. | |
| 2016/0176584 | A1 | 6/2016 | Ishihara et al. | |
| 2016/0176597 | A1 | 6/2016 | Ishihara et al. | |
| 2016/0221727 | A1 | 8/2016 | Stanley et al. | |
| 2016/0297569 | A1 | 10/2016 | You et al. | |
| 2016/0297589 | A1 | 10/2016 | You et al. | |
| 2016/0297590 | A1 | 10/2016 | You et al. | |
| 2016/0297591 | A1 | 10/2016 | You et al. | |
| 2016/0325518 | A1 | 11/2016 | Ishihara et al. | |
| 2016/0362228 | A1 | 12/2016 | McGuire et al. | |
| 2017/0001782 | A1 | 1/2017 | Arent et al. | |

FOREIGN PATENT DOCUMENTS

| | | |
|---|---|---|
| JP | 2006027697 | 2/2006 |
| JP | 2009184690 | 8/2009 |
| JP | 4639677 | 2/2011 |
| JP | 2012025394 | 2/2012 |
| RU | 2038815 | 7/1995 |
| WO | WO1996001775 | 1/1996 |
| WO | WO2005063589 | 7/2005 |
| WO | WO2008064508 | 6/2008 |
| WO | WO2012073004 | 6/2012 |
| WO | WO2013124201 | 8/2013 |

OTHER PUBLICATIONS

"The Rigidified Standing Pouch—A Concept for Flexible Packaging", Phillip John Campbell, A Thesis Written in Partial Fulfillment of the Requirements for the Degree of Master of Industrial Design, North Carolina State University School of Design Raleigh, 1993. pp. 1-35.

All Office Actions, U.S. Appl. No. 14/334,784, filed Jul. 18, 2014.

All Office Actions, U.S. Appl. No. 14/534,203, filed Nov. 6, 2014.

All Office Actions, U.S. Appl. No. 14/534,206, filed Nov. 6, 2014.

All Office Actions, U.S. Appl. No. 15/094,339, filed Apr. 8, 2016.

U.S. Appl. No. 29/526,409, filed May 8, 2015, McGuire et al.

U.S. Appl. No. 15/094,118, filed Apr. 8, 2016, Stanley et al.

U.S. Appl. No. 15/466,898, filed Mar. 27, 2017, Arent et al.

U.S. Appl. No. 15/466,901, filed Mar. 27, 2017, McGuire et al.

* cited by examiner

FLEXIBLE CONTAINERS WITH VENTING STRUCTURE

FIELD

The present disclosure relates in general to flexible containers, and in particular, to flexible containers having a venting structure.

BACKGROUND

Fluent products include liquid products and/or pourable solid products. In various embodiments, a container can be used to receive, contain, and dispense one or more fluent products. And, in various embodiments, a container can be used to receive, contain, and/or dispense individual articles or separately packaged portions of a product. A container can include one or more product spaces. A product space can be configured to be filled with one or more fluent products. A container receives a fluent product when its product space is filled. Once filled to a desired volume, a container can be configured to contain the fluent product in its product space, until the fluent product is dispensed. A container contains a fluent product by providing a barrier around the fluent product. The barrier prevents the fluent product from escaping the product space. The barrier can also protect the fluent product from the environment outside of the container. A filled product space is typically closed off by a cap or a seal. A container can be configured to dispense one or more fluent products contained in its product space(s). Once dispensed, an end user can consume, apply, or otherwise use the fluent product(s), as appropriate. In various embodiments, a container may be configured to be refilled and reused or a container may be configured to be disposed of after a single fill or even after a single use. A container should be configured with sufficient structural integrity, such that it can receive, contain, and dispense its fluent product(s), as intended, without failure.

A container for fluent product(s) can be handled, displayed for sale, and put into use. A container can be handled in many different ways as it is made, filled, decorated, packaged, shipped, and unpacked. A container can experience a wide range of external forces and environmental conditions as it is handled by machines and people, moved by equipment and vehicles, and contacted by other containers and various packaging materials. A container for fluent product(s) should be configured with sufficient structural integrity, such that it can be handled in any of these ways, or in any other way known in the art, as intended, without failure.

A container can also be displayed for sale in many different ways as it is offered for purchase. A container can be offered for sale as an individual article of commerce or packaged with one or more other containers or products, which together form an article of commerce. A container can be offered for sale as a primary package with or without a secondary package. A container can be decorated to display characters, graphics, branding, and/or other visual elements when the container is displayed for sale. A container can be configured to be displayed for sale while laying down or standing up on a store shelf, while presented in a merchandising display, while hanging on a display hanger, or while loaded into a display rack or a vending machine. A container for fluent product(s) should be configured with a structure that allows it to be displayed in any of these ways, or in any other way known in the art, as intended, without failure.

A container can also be put into use in many different ways, by its end user. A container can be configured to be held and/or gripped by an end user, so a container should be appropriately sized and shaped for human hands; and for this purpose, a container can include useful structural features such as a handle and/or a gripping surface. A container can be stored while laying down or standing up on a support surface, while hanging on or from a projection such as a hook or a clip, or while supported by a product holder, or (for refillable or rechargeable containers) positioned in a refilling or recharging station. A container can be configured to dispense fluent product(s) while in any of these storage positions or while being held by the user. A container can be configured to dispense fluent product(s) through the use of gravity, and/or pressure, and/or a dispensing mechanism, such as a pump, or a straw, or through the use of other kinds of dispensers known in the art. Some containers can be configured to be filled and/or refilled by a seller (e.g. a merchant or retailer) or by an end user. A container for fluent product(s) should be configured with a structure that allows it to be put to use in any of these ways, or in any other way known in the art, as intended, without failure. A container can also be configured to be disposed of by the end user, as waste and/or recyclable material, in various ways.

One conventional type of container for fluent products is a rigid container made from solid material(s). Examples of conventional rigid containers include molded plastic bottles, glass jars, metal cans, cardboard boxes, etc. These conventional rigid containers are well-known and generally useful; however their designs do present several notable difficulties.

First, some conventional rigid containers for fluent products can be expensive to make. Some rigid containers are made by a process shaping one or more solid materials. Other rigid containers are made with a phase change process, where container materials are heated (to soften/melt), then shaped, then cooled (to harden/solidify). Both kinds of making are energy intensive processes, which can require complex equipment.

Second, some conventional rigid containers for fluent products can require significant amounts of material. Rigid containers that are designed to stand up on a support surface require solid walls that are thick enough to support the containers when they are filled. This can require significant amounts of material, which adds to the cost of the containers and can contribute to difficulties with their disposal.

Third, some conventional rigid containers for fluent products can be difficult to decorate. The sizes, shapes, (e.g. curved surfaces) and/or materials of some rigid containers, make it difficult to print directly on their outside surfaces. Labeling requires additional materials and processing, and limits the size and shape of the decoration. Overwrapping provides larger decoration areas, but also requires additional materials and processing, often at significant expense.

Fourth, some conventional rigid containers for fluent products can be prone to certain kinds of damage. If a rigid container is pushed against a rough surface, then the container can become scuffed, which may obscure printing on the container. If a rigid container is pressed against a hard object, then the container can become dented, which may look unsightly. And if a rigid container is dropped, then the container can rupture, which may cause its fluent product to be lost.

Fifth, some fluent products in conventional rigid containers can be difficult to dispense. When an end user squeezes a rigid container to dispense its fluent product, the end user must overcome the resistance of the rigid sides, to deform the container. Some users may lack the hand strength to easily overcome that resistance; these users may dispense less than their desired amount of fluent product. Other users may need to apply so much of their hand strength, that they cannot easily control how much they deform the container; these users may dispense more than their desired amount of fluent product.

Sixth, when using conventional rigid containers, it can be difficult for a manufacturer to change such containers from one product size to another product size. When a product manufacturer offers a fluent product in a conventional rigid container, and the manufacturer needs to change the size of the product, the change usually requires the manufacturer to make and use a new size of container for the new amount. Unfortunately, making a new size of that container can be costly, time-consuming, and challenging to coordinate.

SUMMARY

The present disclosure describes various embodiments of containers made from flexible material. Because these containers are made from flexible material, these containers offer a number of advantages, when compared with conventional rigid containers.

First, these containers can be less expensive to make, because the conversion of flexible materials (from sheet form to finished goods) generally requires less energy and complexity, than formation of rigid materials (from bulk form to finished goods). Second, these containers can use less material, because they are configured with novel support structures that do not require the use of the thick solid walls used in conventional rigid containers. Third, these flexible containers can be easier to print and/or decorate, because they are made from flexible materials, and flexible materials can be printed and/or decorated as conformable webs, before they are formed into containers. Fourth, these flexible containers can be less prone to scuffing, denting, and rupture, because flexible materials allow their outer surfaces to deform when contacting surfaces and objects, and then to bounce back. Fifth, fluent products in these flexible containers can be more readily and carefully dispensed, because the sides of flexible containers can be more easily and controllably squeezed by human hands. Even though the containers of the present disclosure are made from flexible material, they can be configured with sufficient structural integrity, such that they can receive, contain, and dispense fluent product(s), as intended, without failure. Also, these containers can be configured with sufficient structural integrity, such that they can withstand external forces and environmental conditions from handling, without failure. Further, these containers can be configured with structures that allow them to be displayed and put into use, as intended, without failure. Sixth, these flexible containers can be configured with easily variable sizing, allowing a product manufacturer to change a product's size with less expense, in less time, and with less coordination, when compared with conventional rigid containers. While flexible containers offer these significant advantages over conventional rigid containers, flexible containers can require specially designed features, such as a venting structure, as described herein

DETAILED DESCRIPTION

The present disclosure describes various embodiments of containers made from flexible material. Because these containers are made from flexible material, these containers offer a number of advantages, when compared with conventional rigid containers.

Even though the containers of the present disclosure are made from flexible material, they can be configured with sufficient structural integrity, such that they can receive, contain, and dispense fluent product(s), as intended, without failure. Also, these containers can be configured with sufficient structural integrity, such that they can withstand external forces and environmental conditions from handling, without failure. Further, these containers can be configured with structures that allow them to be displayed for sale and put into use, as intended, without failure.

Figure 1A:
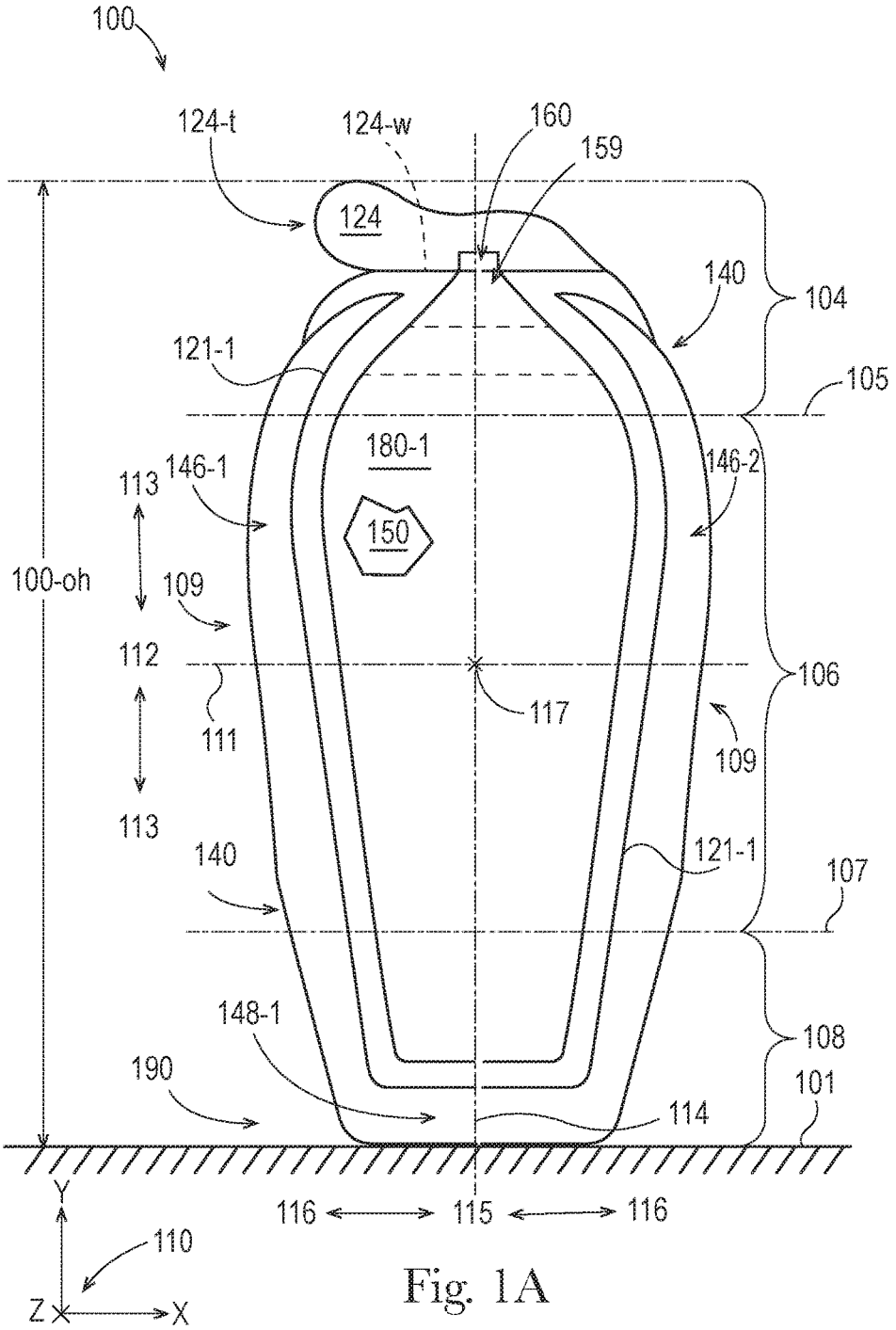
FIG. 1A illustrates a front view of an embodiment of a stand up flexible container.

FIGS. 1A-1G illustrate various views of an embodiment of a stand up flexible container 100. FIG. 1A illustrates a front view of the container 100. The container 100 is standing upright on a horizontal support surface 101. The flexible container 100 is a film-based container, made entirely of film laminates.

In the embodiments of FIG. 1A-1G, a coordinate system 110, provides lines of reference for referring to directions in the figure. The coordinate system 110 is a three-dimensional Cartesian coordinate system with an X-axis, a Y-axis, and a Z-axis, wherein each axis is perpendicular to the other axes, and any two of the axes define a plane. The X-axis and the Z-axis are parallel with the horizontal support surface 101 and the Y-axis is perpendicular to the horizontal support surface 101.

FIGS. 1A-1G also includes other lines of reference, for referring to directions and locations with respect to the container 100. A lateral centerline 111 runs parallel to the X-axis. An XY plane at the lateral centerline 111 separates the container 100 into a front half and a back half. An XZ plane at the lateral centerline 111 separates the container 100 into an upper half and a lower half. A longitudinal centerline 114 runs parallel to the Y-axis. A YZ plane at the longitudinal centerline 114 separates the container 100 into a left half and a right half. A third centerline 117 runs parallel to the Z-axis. The lateral centerline 111, the longitudinal centerline 114, and the third centerline 117 all intersect at a center of the container 100.

A disposition with respect to the lateral centerline 111 defines what is longitudinally inboard 112 and longitudinally outboard 113. A disposition with respect to the longitudinal centerline 114 defines what is laterally inboard 115 and laterally outboard 116. A disposition in the direction of the third centerline 117 and toward a front 102-1 of the container is referred to as forward 118 or in front of. A disposition in the direction of the third centerline 117 and toward a back 102-2 of the container is referred to as backward 119 or behind.

The container 100 includes a gusseted top 104, a middle 106, and a gusseted bottom 108, the front 102-1, the back 102-2, and left and right sides 109. The top 104 is separated from the middle 106 by a reference plane 105, which is parallel to the XZ plane. The middle 106 is separated from the bottom 108 by a reference plane 107, which is also parallel to the XZ plane. The container 100 has an overall height of 100-*oh*. In the embodiment of FIG. 1A, the front 102-1 and the back 102-2 of the container are joined together at a seal 129, which extends along portions of the sides 109 of the container 100.

The container 100 includes a sealed tear tab 124, a structural support frame 140, a product space 150, a dispenser 160, panels 180-1 and 180-2, and a base structure 190. A portion of panel 180-1 is illustrated as broken away, in order to illustrate the product space 150. The product space 150 is configured to contain one or more fluent products.

The tear tab 124 is formed at the distal end of a sealed leg 144-1 of a top gusset, disposed in the top 104 of the container 100, and in the front 102-1. When the tear off portion 124 is removed, by pulling on a protruding tab 124-*t*, and causing separation along a line of weakness 124-*w*, the container 100 can dispense fluent product(s) from the product space 150 through a flow channel 159 then through the dispenser 160, to the environment outside of the container 100. In the embodiment of FIGS. 1A-1G, the dispenser 160 is disposed in the top 104, however, in various alternate embodiments, the dispenser 160 can be disposed anywhere else on the top 140, middle 106, or bottom 108, including anywhere on either of the sides 109, on either of the panels 180-1 and 180-2, and on any part of the base 190 of the container 100. The structural support frame 140 supports the mass of fluent product(s) in the product space 150, and makes the container 100 stand upright.

The panels 180-1 and 180-2 are squeeze panels, made of a film laminate. Panel 180-1 overlays a front of the product space 150. Substantially all of a periphery of the panel 180-1 is surrounded by a front panel seal 121-1. Panel 180-2 overlays a back of the product space 150. Substantially all of a periphery of the panel 180-2 is surrounded by a back panel seal 121-2. The panels 180-1 and 180-2 are relatively flat surfaces, suitable for displaying any kind of indicia. However, in various embodiments, part, parts, or about all, or approximately all, or substantially all, or nearly all, or all of either or both of the panels 180-1 and 180-2 can include one or more curved surfaces. The base structure 190 is part of the structural support frame 140 and provides stability to the container 100 as it stands upright.

The structural support frame 140 is formed by a plurality of structural support members, each of which is an expanded structural support volume, made from a film laminate. The structural support frame 140 includes top structural support member 144-2, middle structural support members 146-1, 146-2, 146-3, and 146-4, as well as bottom structural support members 148-1 and 148-2.

The top structural support member 144-2 is formed in a folded leg of a top gusset, disposed in the top 104 of the container 100, and in the back 102-2. The top structural support member 144-2 is adjacent to the sealed leg 144-1 of the top gusset that includes the flow channel 159 and the dispenser 160. The flow channel 158 allows the container 100 to dispense fluent product(s) from the product space 150 through the flow channel 159 then through the dispenser 160.

The top structural support member 144-2 is disposed substantially above the product space 150. Overall, the top structural support member 144-2 is oriented about horizontally, but with its ends curved slightly downward. The top structural support member 144-2 has a cross-sectional area that is substantially uniform along its length; however the cross-sectional areas at its ends are slightly larger than the cross-sectional area in its middle.

The middle structural support members 146-1, 146-2, 146-3, and 146-4 are disposed on the left and right sides 109, from the top 104, through the middle 106, to the bottom 108. The middle structural support member 146-1 is disposed in the front 102-1, on the left side 109; the middle structural support member 146-4 is disposed in the back 102-2, on the left side 109, behind the middle structural support member 146-1. The middle structural support members 146-1 and 146-4 are adjacent to each other and in contact with each other along parts of their lengths, except that a lower portion of the middle structural support member 146-1 and a lower portion of the middle structural support member 146-4 are spaced apart from each other by a reinforcing seal 127. In various embodiments, the middle structural support members 146-1 and 146-4 can be in contact with each other at one or more relatively smaller locations and/or at one or more relatively larger locations, along part, or parts, or about all, or approximately all, or substantially all, or nearly all, or all of their overall lengths. The middle structural support members 146-1 and 146-4 are not directly connected to each other. However, in various alternate embodiments, the middle structural support members 146-1 and 146-4 can be directly connected and/or joined together along part, or parts, or about all, or approximately all, or substantially all, or nearly all, or all of their overall lengths.

The middle structural support member 146-2 is disposed in the front 102-1, on the right side 109; the middle structural support member 146-3 is disposed in the back 102-2, on the right side 109, behind the middle structural support member 146-2. The middle structural support members 146-2 and 146-3 are adjacent to each other and in contact with each other along substantially all of their lengths, except that a lower portion of the middle structural support member 146-2 and a lower portion of the middle structural support member 146-3 are spaced apart from each other by a reinforcing seal 127. In various embodiments, the middle structural support members 146-2 and 146-3 can be in contact with each other at one or more relatively smaller locations and/or at one or more relatively larger locations, along part, or parts, or about all, or approximately all, or substantially all, or nearly all, or all of their overall lengths. The middle structural support members 146-2 and 146-3 are not directly connected to each other. However, in various alternate embodiments, the middle structural support members 146-2 and 146-3 can be directly connected and/or joined together along part, or parts, or about all, or approximately all, or substantially all, or nearly all, or all of their overall lengths.

The middle structural support members 146-1, 146-2, 146-3, and 146-4 are disposed substantially laterally outboard from the product space 150. Overall, each of the middle structural support members 146-1, 146-2, 146-3, and 146-4 is oriented about vertically, but angled slightly, with its upper and lower ends angled laterally inboard. Each of the middle structural support members 146-1, 146-2, 146-3, and 146-4 has a cross-sectional area that varies along its length.

The bottom structural support members 148-1 and 148-2 are disposed on the bottom 108 of the container 100, each formed in one folded leg of a bottom gusset. The bottom structural support member 148-1 is disposed in the front 102-1 and the bottom structural support member 148-2 is disposed in the back 102-2, behind the bottom structural support member 148-1. The bottom structural support members 148-1 and 148-2 are substantially parallel to each other but are offset from each other and not in contact with each other.

The bottom structural support members 148-1 and 148-2 are disposed substantially below the product space 150, and are part of the base structure 190. Overall, each of the bottom structural support members 148-1 and 148-2 is oriented horizontally and substantially laterally, with its outward facing ends curved slightly upward. Each of the bottom structural support members 148-1 and 148-2 has a cross-sectional area that is substantially uniform along its length. Each of the bottom structural support members 148-1 and 148-2 is in contact with the horizontal support 101 surface along substantially all of its length. However, in various embodiments, about all, or approximately all, or substantially all, or nearly all, or all of a bottom structural support member may contact a horizontal support surface.

The bottom structural support members 148-1 and 148-2 are connected to each other by bottom middle structural support members 149-1 and 149-2, which are also part of the base structure 190. Overall, each of the bottom middle structural support members 148-1 and 148-2 is oriented horizontally and substantially parallel to a third centerline of a container. Each of the bottom middle structural support members 149-1 and 149-2 has a cross-sectional area that is smaller in its middle and larger at its ends. Each of the bottom middle structural support members 149-1 and 149-2 is in contact with the horizontal support 101 surface at its ends, but not at its middle. However, in various embodiments, about all, or approximately all, or substantially all, or nearly all, or all of a bottom middle structural support member may contact a horizontal support surface.

In the base structure 190, the right end of the bottom structural support member 148-1 is joined to the front end of the bottom middle structural support member 149-2; the back end of the bottom middle structural support member 149-2 is joined to the right end of the bottom structural support member 148-2; the left end of the bottom structural support member 147-2 is joined to the back end of the bottom middle structural support member 149-1; and the front end of the bottom middle structural support member 149-1 is joined to the left end of the bottom structural support member 148-1.

The structural support members 148-1, 149-2, 148-2, and 149-1, together surround a bottom panel 191, which has an overall shape that is substantially rectangular, with rounded corners. The bottom panel is made of a film laminate and is disposed underneath and adjacent to a bottom portion of the product space 150. In the embodiment of FIGS. 1A-1G, no part of the bottom panel 191 contacts the horizontal support surface 101 but all of the bottom panel 191 is raised off of the horizontal support surface 101; however, in various embodiments, approximately all, or substantially all, or nearly all, of a bottom panel may be raised off of a horizontal support surface while part, parts, or all of a bottom panel may contact a horizontal support surface.

Each of the reinforcing seals 127 is formed by sealed portions that are bounded by edges that are shared with the bottom portions of middle structural support members and a middle portion of a bottom middle structural support member, on each side, such that each reinforcing seal 127 has an overall shape that is a substantially triangular shape. On the left side 109 of the container 100, the reinforcing seal 127 is formed by sealed portions that are bounded by edges that are shared with the bottom portion of middle structural support members 146-1 and 146-4 and a middle portion of a bottom middle structural support member 149-1. On the right side 109 of the container 100, the reinforcing seal 127 is formed by sealed portions that are bounded by edges that are shared with the bottom portion of middle structural support members 146-2 and 146-3 and a middle portion of a bottom middle structural support member 149-2.

In the front portion of the structural support frame 140, the upper end of the middle structural support member 146-1 is a free end disposed toward one side 109 of the container 100; the lower end of the middle structural support member 146-1 is joined to the left end of the bottom structural support member 148-1; the right end of the bottom structural support member 148-1 is joined to the lower end of the middle structural support member 146-2; and the upper end of the middle structural support member 146-2 is a free end disposed toward another side 109 of the container 100. The structural support members 146-1, 148-1, and 146-2, together surround substantially all of the panel 180-1, except for a gap between the upper end of the middle structural support member 146-1 and the upper end of the middle structural support member 146-2, which are not connected by a structural support member, to provide an unobstructed pathway for the flow channel 159.

Similarly, in the back portion of the structural support frame 140, the left end of the top structural support member 144-2 is joined to the upper end of the middle structural support member 146-4; the lower end of the middle structural support member 146-4 is joined to the left end of the bottom structural support member 148-2; the right end of the bottom structural support member 148-2 is joined to the lower end of the middle structural support member 146-3; and the upper end of the middle structural support member 146-3 is joined to the right end of the top structural support member 144-2. The structural support members 144-2, 146-2, 148-2, and 146-2, together surround substantially all of the panel 180-2.

In the structural support frame 140, the ends of the structural support members, which are joined together, are directly connected, around the periphery of their walls. However, in various alternative embodiments, any of the structural support members 144-2, 146-1, 146-2, 146-3, 146-4, 148-1, and 148-2 can be joined together in any way described herein or known in the art.

In alternative embodiments of the structural support frame 140, adjacent structural support members can be combined into a single structural support member, wherein the combined structural support member can effectively substitute for the adjacent structural support members, as their functions and connections are described herein. In other alternative embodiments of the structural support frame 140, one or more additional structural support members can be added to the structural support members in the structural support frame 140, wherein the expanded structural support frame can effectively substitute for the structural support frame 140, as its functions and connections are described herein.

Also, in some alternative embodiments, a flexible container may not include a base structure.

Figure 1B:
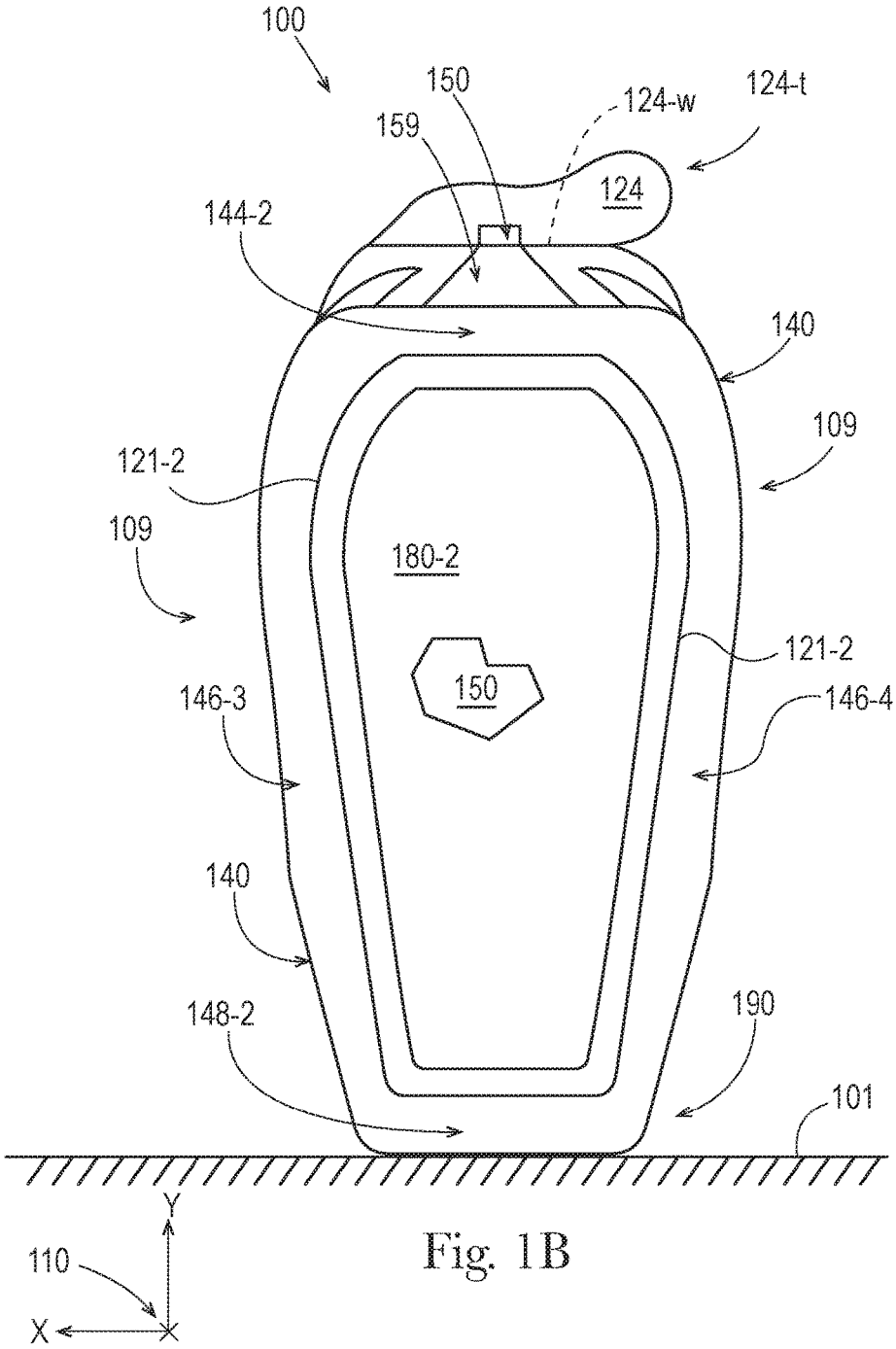
FIG. 1B illustrates a back view of the stand up flexible container of FIG. 1A.

FIG. 1B illustrates a back view of the stand up flexible container of FIG. 1A.

Figure 1C:
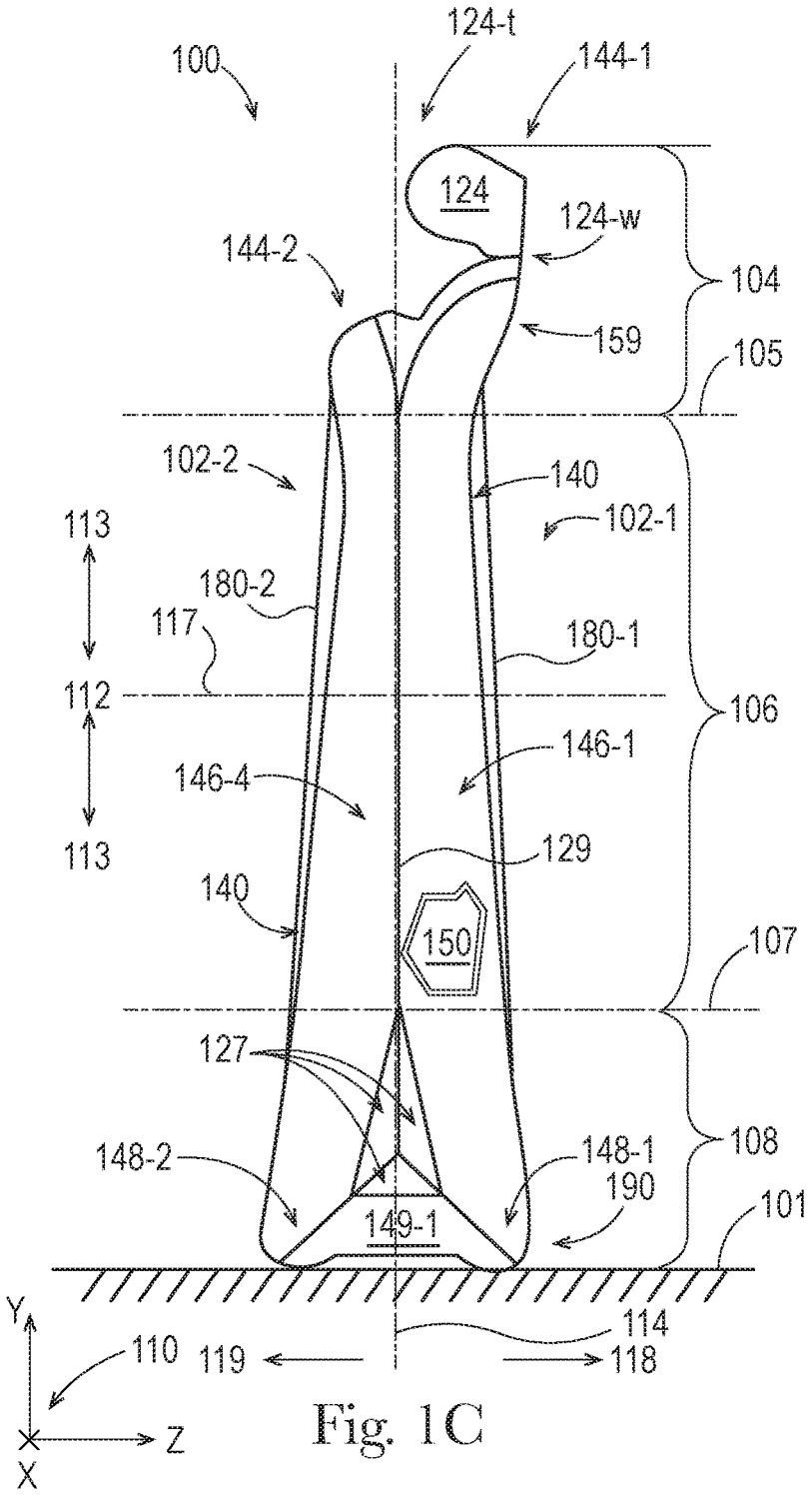
FIG. 1C illustrates a left side view of the stand up flexible container of FIG. 1A.

FIG. 1C illustrates a left side view of the stand up flexible container of FIG. 1A.

Figure 1D:
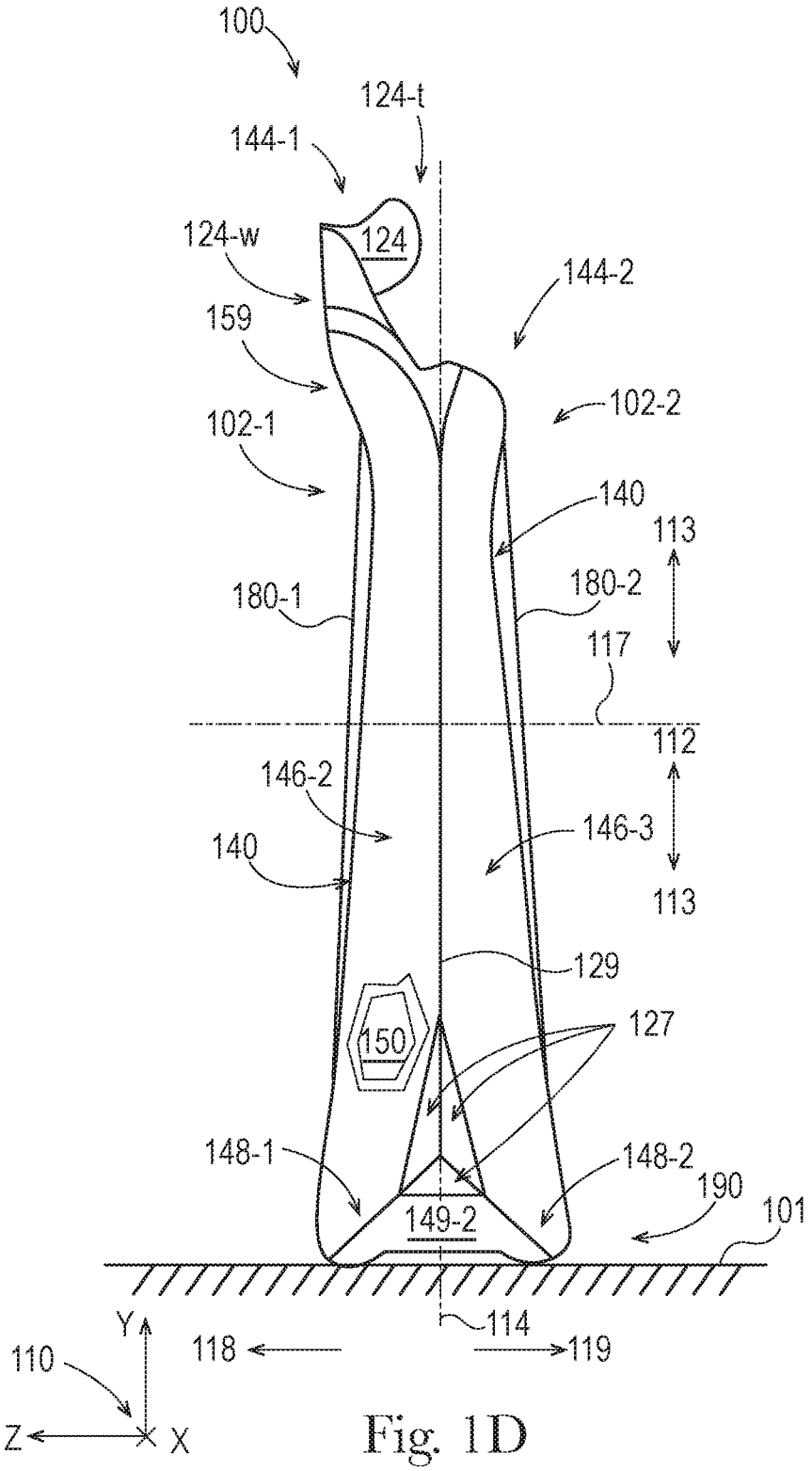
FIG. 1D illustrates a right side view of the stand up flexible container of FIG. 1A.

FIG. 1D illustrates a right side view of the stand up flexible container of FIG. 1A.

Figure 1E:
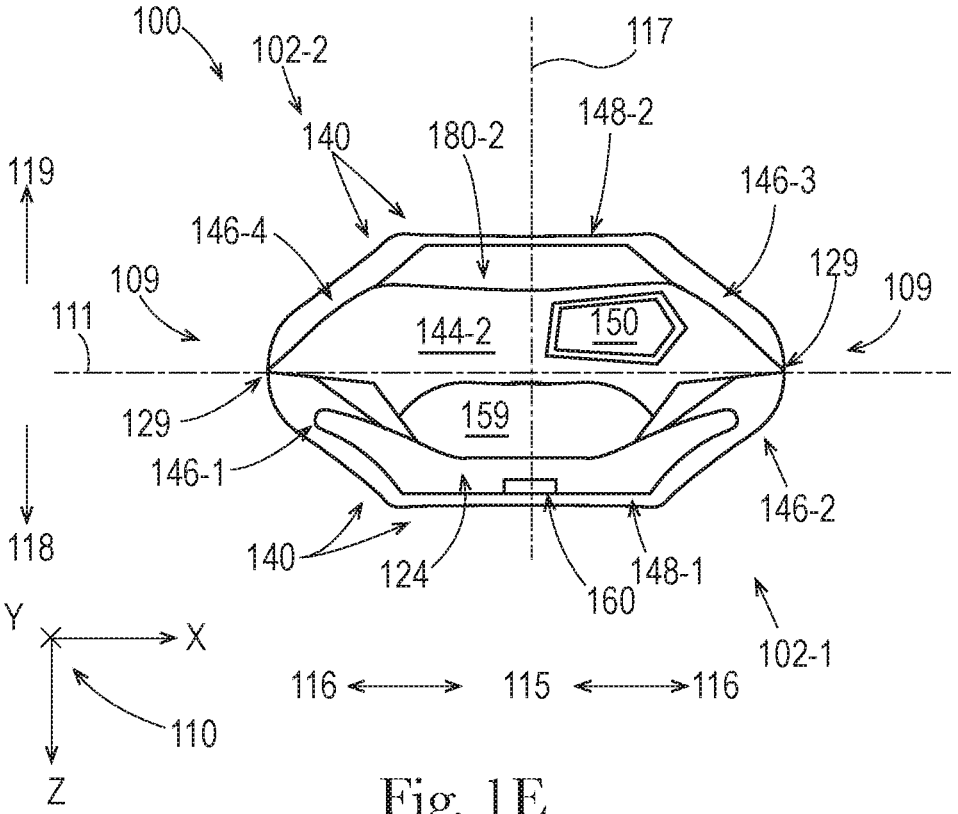
FIG. 1E illustrates a top view of the stand up flexible container of FIG. 1A.

FIG. 1E illustrates a top view of the stand up flexible container of FIG. 1A.

Figure 1F:
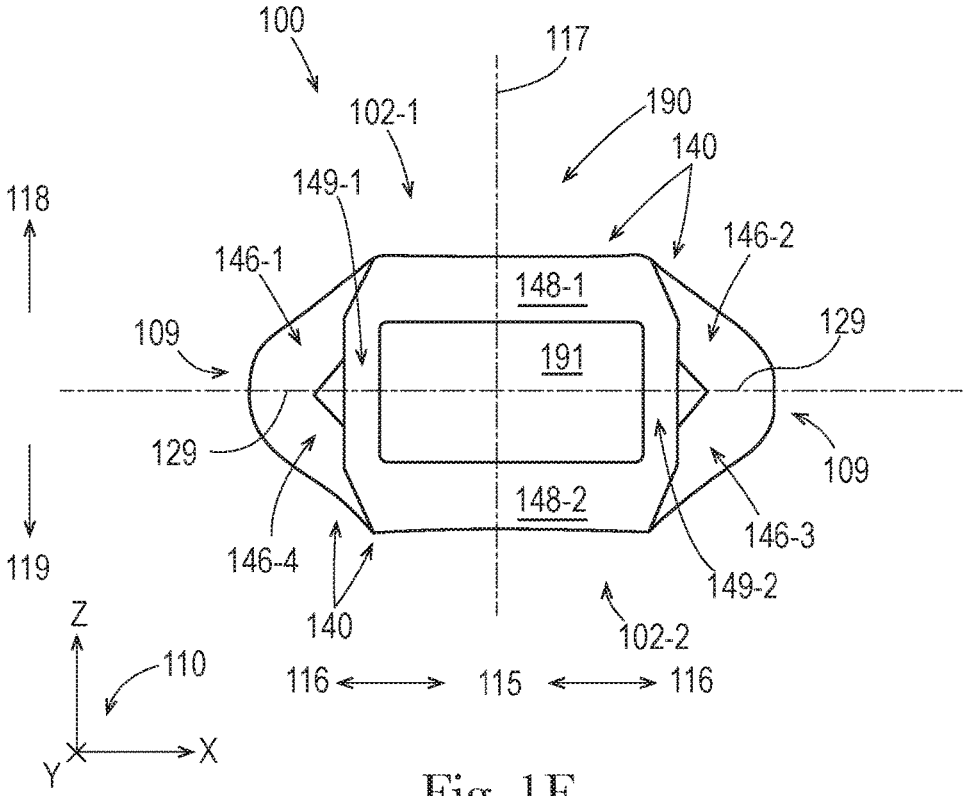
FIG. 1F illustrates a bottom view of the stand up flexible container of FIG. 1A.

FIG. 1F illustrates a bottom view of the stand up flexible container of FIG. 1A.

Figure 1G:
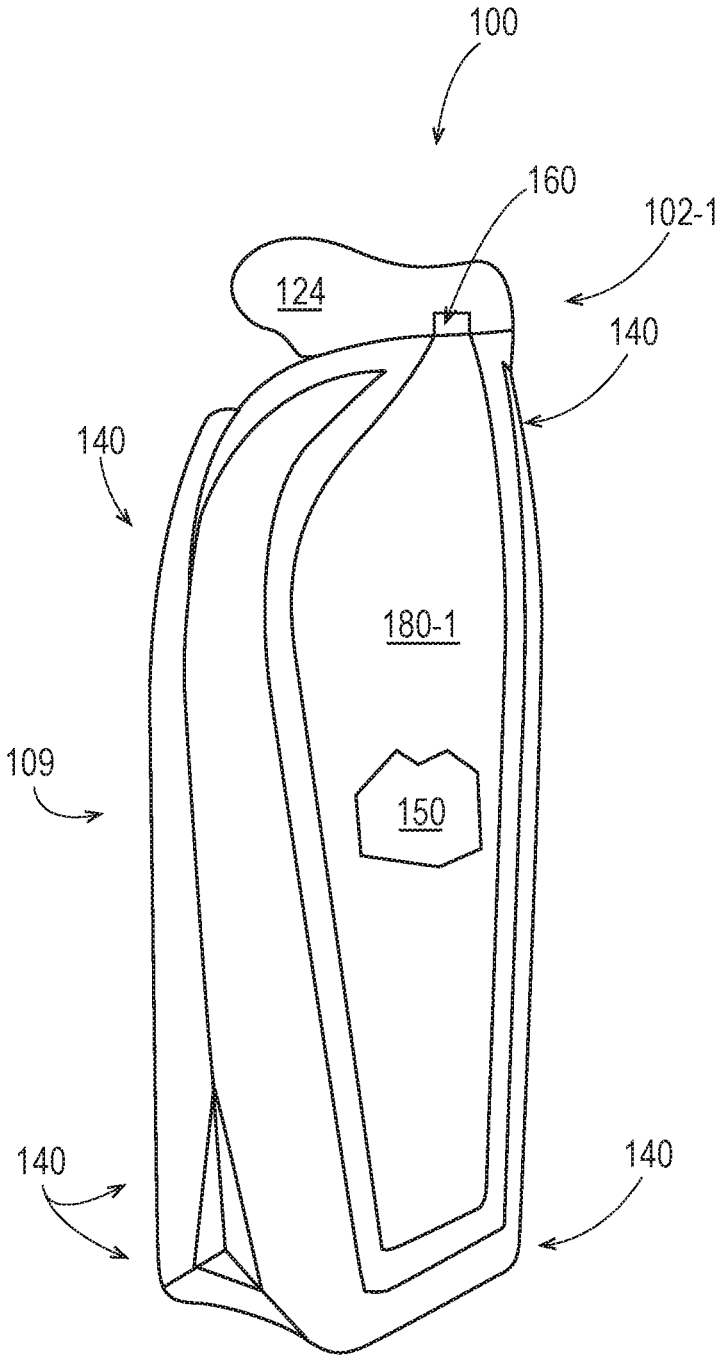
FIG. 1G illustrates a perspective view of the stand up flexible container of FIG. 1A.

FIG. 1G illustrates a perspective view of the stand up flexible container of FIG. 1A.

Figure 2:
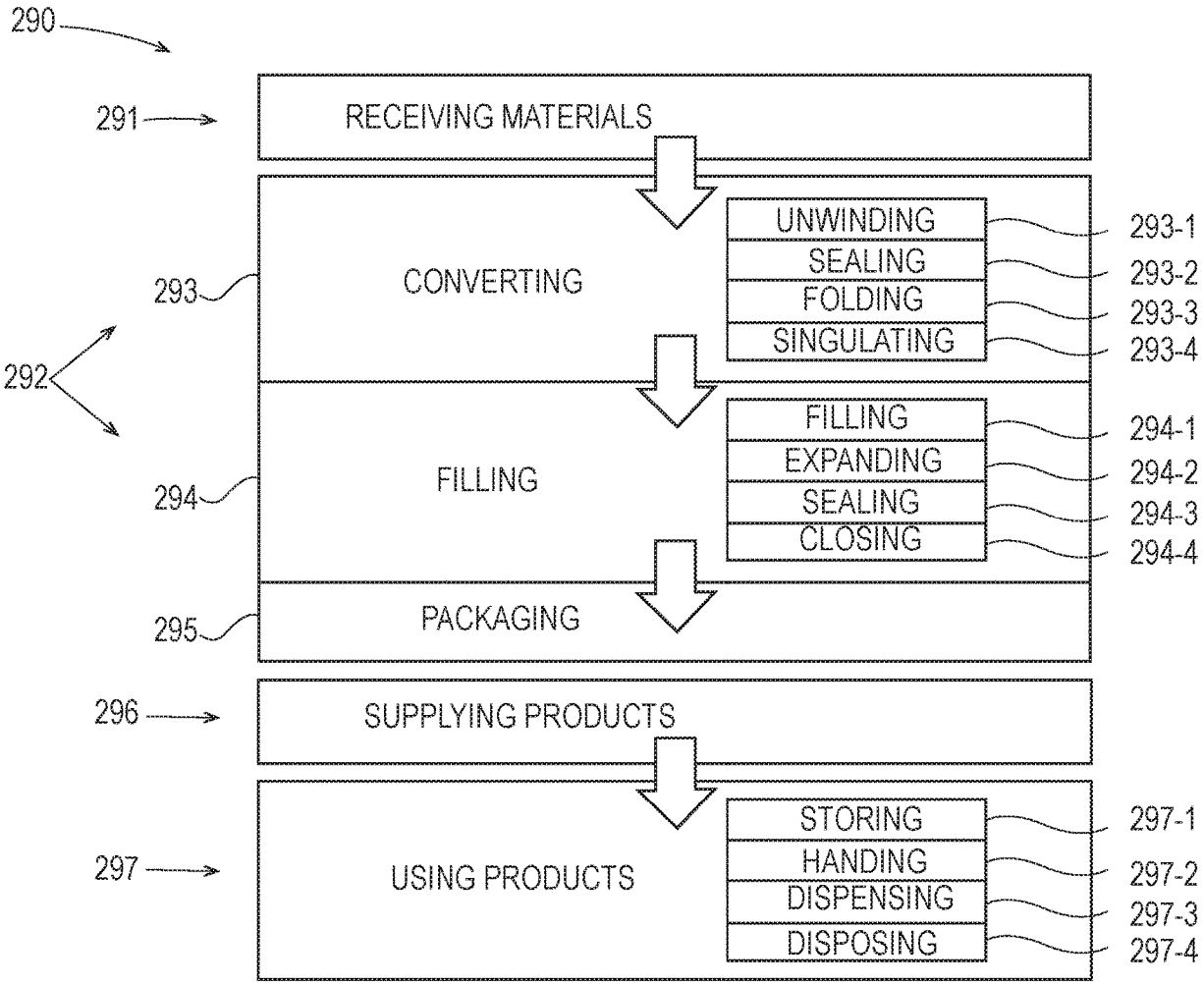
FIG. 2 is a flowchart illustrating a process of how a flexible container is made, supplied, and used.

FIG. 2 is a flowchart illustrating a process 290 of how a product with a flexible container is made, supplied, and used. The process 290 begins with receiving 291 materials, then continues with the making 292 of the product, followed by supplying 296 the product, and finally ends with using 297 the product.

The receiving 291 of materials can include receiving any materials and/or ingredients for making the product (e.g. ingredients for making a fluent product) and/or the container for the product (e.g. flexible materials to be converted into a flexible container). The flexible materials can be any kind of suitable flexible material, as disclosed herein and/or as known in the art of flexible containers and/or in U.S. non-provisional patent application Ser. No. 13/889,061 filed May 7, 2013, entitled "Flexible Materials for Flexible Containers" published as US20130337244 and/or in U.S. non-provisional patent application Ser. No. 13/889,090 filed May 7, 2013, entitled "Flexible Materials for Flexible Containers" published as US20130294711, and/or U.S. provisional patent application 62/186,704 filed Jun. 30, 2015 entitled "Flexible Containers with Removable Portions," each of which is hereby incorporated by reference.

The making 292 includes the processes of converting 293, filling 294, and packaging 295. The converting 293 process is the process for transforming one or more flexible materials and/or components, from the receiving 291, into a flexible container, as described herein. The converting 293 process includes the further processes of unwinding 293-1, sealing 293-2, and folding 293-3 the flexible materials then (optionally) singulating 293-4 the flexible materials into individual flexible containers. The filling process 294 includes the further processes of filling 294-1 one or more product spaces of the individual flexible containers, from the converting 293, with one or more fluent products, expanding 294-2 one or more structural support volumes with one or more expansion materials, then sealing 294-3 the one or structural support frames and sealing 294-3 and/or closing 294-4 the one or more product spaces. The packaging 295 process includes placing the filled product with a flexible container, from the filling 294, into one or more packages (e.g. cartons, cases, shippers, etc.) as known in the art of packaging. In various embodiments of the process 290, the packaging 295 process may be omitted. In various embodiments, the processes of making 292 can be performed in various orders, and additional/alternate processes for making flexible containers can be performed.

Any of the making 292 processes can be accomplished according to any of the embodiments described here and/or as known in the art of making flexible containers and/or in U.S. non-provisional patent application Ser. No. 13/957,158 filed Aug. 1, 2013, entitled "Methods of Making Flexible Containers" published as US20140033654 and/or in U.S. non-provisional patent application Ser. No. 13/957,187 filed Aug. 1, 2013, entitled "Methods of Making Flexible Containers" published as US20140033655 and/or in U.S. non-provisional patent application Ser. No. 14/448,491 filed Jul. 31, 2014, entitled "Methods of Forming a Flexible Container" published as US20150033671 and/or in U.S. non-provisional patent application Ser. No. 14/534,197 filed Nov. 6, 2014, entitled "Flexible Containers and Methods of Forming the Same" published as US20150126349 and/or in U.S. non-provisional patent application Ser. No. 14/534,210 filed Nov. 6, 2014, entitled "Flexible Containers and Methods of Forming the Same" published as US 20150125099 and/or in U.S. non-provisional patent application Ser. No. 14/534,213 filed Nov. 6, 2014, entitled "Flexible Containers and Methods of Making the Same" published as US 20150122373 and/or in U.S. non-provisional patent application Ser. No. 14/534,214 filed Nov. 6, 2013, entitled "Flexible Containers and Methods of Making the Same" published as US20150121810, each of which is hereby incorporated by reference.

A machine for making 292 a flexible container, as described in connection with embodiments of FIG. 2, can include a particular set of unit operations for sealing (e.g. sealing 293-2) flexible materials with a particular sealing pattern, resulting in a flexible container with a particular sealed configuration, as described herein.

A machine for making 292 a flexible container, as described in connection with embodiments of FIG. 2, can include a particular set of unit operations for folding (e.g. folding 293-3) flexible materials with a particular folding pattern, resulting in a flexible container with a particular folded configuration, as described herein.

The supplying 296 of the product includes transferring the product, from the making 292, to product purchasers and/or ultimately to product users, as known in the art of supplying. The using 297 of the product includes the processes of storing 297-1, handling 297-2, dispensing 297-3, and disposing 297-4 of the product, as described herein and is known in the art of using products with flexible containers. Part, parts, or all of the process 290 can be used to make products with flexible containers of the present disclosure, including products with line-ups of flexible containers.

Figure 3A:
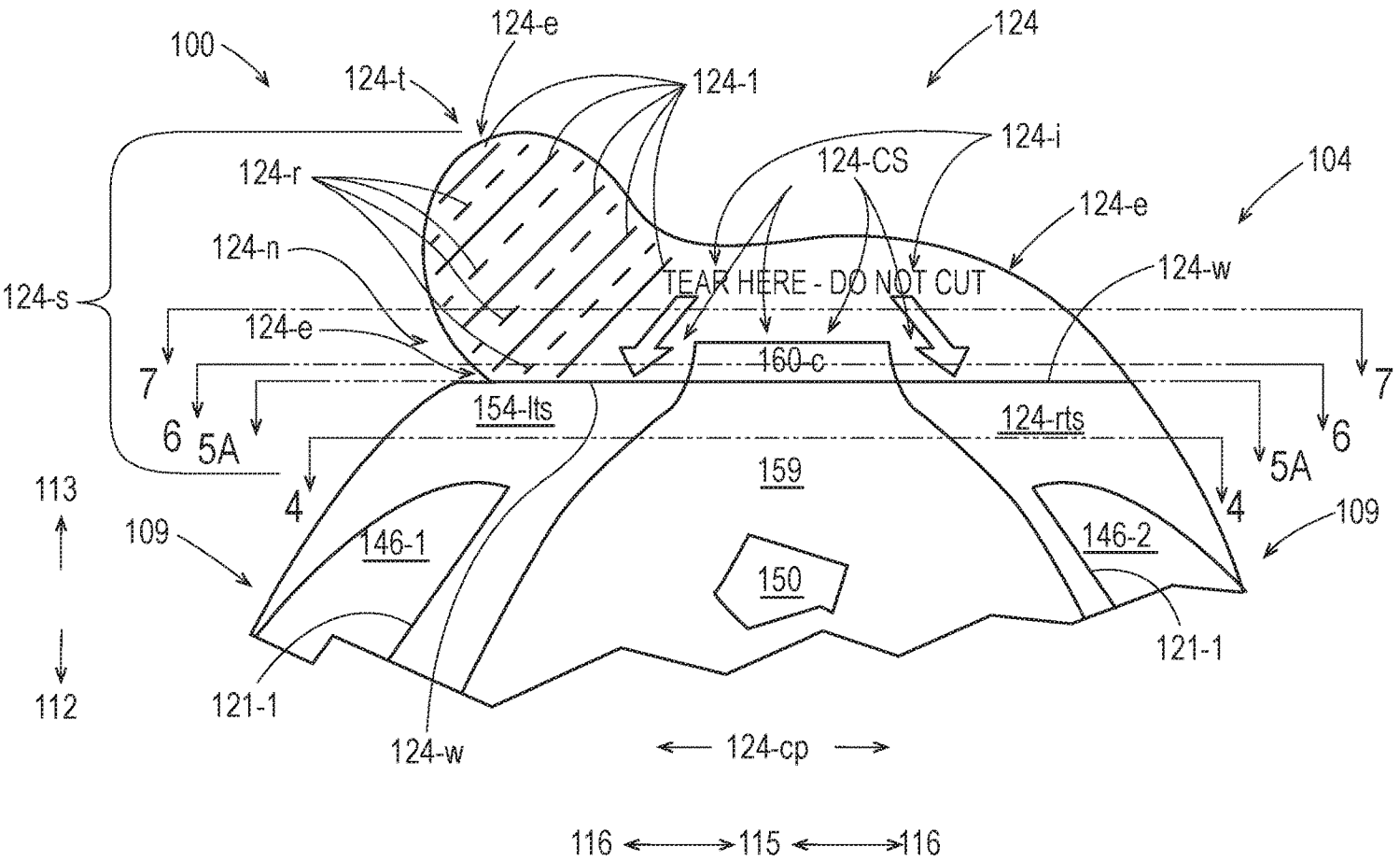
FIG. 3A illustrates an enlarged front view of a top portion of the stand up flexible container of FIG. 1A.

FIG. 3A illustrates an enlarged front view of a top portion of the stand up flexible container 100 of FIGS. 1A-1G. The container 100 includes a film structure 124-*s*, made from film laminates, as described in connection with FIGS. 4-7; however in various embodiments a flexible container may have a film structure made from various films, film laminates, and/or other flexible materials. The container 100 includes a pathway of weakness, which is the line of weakness 124-*w*; the pathway of weakness 124-*w* extends horizontally across the entire film structure 124-*s*, although in various embodiments of flexible containers, a pathway of weakness may extend over part or parts of the film structure 124-*s*, with one or more shapes that are straight, curved, angled, segmented, or other shapes, or combinations of any of these shapes, in any suitable orientation with respect to a film structure.

Adjacent to and longitudinally inboard 112 to the pathway of weakness 124-*w*, the film structure 124-*s* includes a left top seal 124-*lts*, a partially sealed central portion 124-*cp*, and a right top seal 124-*rts*. The left top seal 124-*lts* is disposed above an upper end of the middle support structure 146-1 and extends from the left side 109 of the container 100, laterally inward 115, where it connects to an upper end of a left side of the panel seal 121-1. The right top seal 124-*rts* is disposed above an upper end of the middle support structure 146-2 and extends from the right side 109 of the container 100, laterally inward, 115 where it connects to an upper end of a right side of the panel seal 121-1. The partially sealed central portion 124-*cp* is disposed between the left top seal 124-*lts* and the right top seal 124-*rts*. Longitudinally inboard 115 to the pathway of weakness 124-*w*, the partially sealed central portion 124-*cp* includes inner and outer unsealed portions between certain film laminates of the film structure 124-*s*, as described and illustrated in connection with the cross-sectional view of FIG. 4, which is taken at the section line shown in FIG. 3A, laterally across the container 100, from the left side 109, through the middle of the left top seal 124-*lts*, through the middle of the partially sealed central portion 124-*cp*, through the middle of the right top seal 124-*rts*, and to the right side 109.

Along the pathway of weakness 124-*w*, the film structure 124-*s* includes an uppermost part of the left top seal 124-*lts*, a portion of the partially sealed central portion 124-*cp*, and an uppermost part of the right top seal 124-*rts*. Along the pathway of weakness 124-*w*, the film structure 124-*s* includes scores on and cuts through the materials of the film structure 124-*s*, as described in connection with FIG. 3B. Along the pathway of weakness 124-*w*, the film structure 124-*s* may also include one or more dots, dashes, lines, and/or other indicia, printed onto one or more of the film laminates, and visible from a front and/or back of the container 100; these indicia can vary in type, size, and/or number, in any convenient way, to at least assist in providing a visual signal that indicates the presence and/or location of part, parts, or all of the pathway of weakness 124-*w*. Adjacent to and longitudinally inboard 112 to the pathway of weakness 124-*w*, the partially sealed central portion 124-*cp* includes inner and outer unsealed portions between certain film laminates of the film structure 124-*s*, as described and illustrated in connection with the cross-sectional view of FIG. 5A, which is taken at the section line shown in FIG. 3A, along the pathway of weakness 124-*w*, laterally across the container 100, from the left side 109, through the uppermost part of the left top seal 124-*lts*, through a portion of the partially sealed central portion 124-*cp*, through the uppermost part of the right top seal 127-*rts*, and to the right side 109.

Adjacent to and longitudinally outboard 113 from the pathway of weakness 124-*w*, the film structure 124-*s* includes a removable portion, which is the tear off portion 124. All of the removable portion 124 is made from all of the laminates of the film structure 124-*s*, although in various embodiments part, parts, or all a removable portion may be made from fewer than all of the laminates of a film structure, optionally along with one or more additional materials, such as other flexible or rigid materials. In the embodiment of FIG. 3A, since the dispenser 160 is disposed in a top 104 of the container 100, the removable portion 124 is disposed above the pathway of weakness 124-*w*. However, in other embodiments, the removable portion 124 may be disposed in other locations and/or orientations with respect to the container 100; for example, in a bottom dispensing embodiment, the removable portion 124 may be disposed below a pathway of weakness.

In the removable portion 124, the film structure 124-*s* includes an outside edge 124-*e*, a tear tab 124-*t*, a tear-propagation notch 124-*n*, and a sealed cavity 160-*c*, which is surrounded by a cap seal 124-*cs*. In the embodiment of FIG. 3A, on the right side, the outside edge 124-*e* of the removable portion 124 aligns with an outside edge of the top right seal 124-*rts*, although in various embodiments these edges may not be aligned. The outside edge 124-*e* is smooth and continuously curved, but part, parts, or all of an outside edge can include any convenient edge shape(s), cut using any kind of cutting die, laser cutter, water-jet cutter, or any other kind of cutting apparatus known in the art.

An upper left portion of the outside edge 124-*e* protrudes to form the tear tab 124-*t*, which is configured for humans to grasp and pull with their fingers. The tear tab 124-*t* includes a plurality of ridges 124-*r*, embossed into one or more of the film laminates, and disposed on a back of the tear tab 124-*t*; in various embodiments, ridges can alternatively or additionally be disposed on a front of a tear tab. The ridges 124-*r* are substantially parallel to each other and are disposed at an angle of 1-70 degrees with respect to the overall direction of the pathway of weakness 124-*w*. The ridges 124-*r* can vary in type, size, number, and/or orientation, in any convenient way, to at least assist in providing grip on the tear tab 124-*t*. In various embodiments, the tear tab 124-*r* can include any number of any other kind of gripping elements known in the art, in addition to or instead of the ridges 124-*r*. The tear tab also 124-*t* includes a plurality of lines 124-1, printed onto one or more of the film laminates, visible from a front and/or back of the tear tab 124-*t*, and disposed substantially parallel to the embossed ridges 124-*r*. The lines 124-1 can also vary in type, size, number, and/or orientation, in any convenient way, to at least assist in providing a visual signal that indicates the presence and/or orientation of part, parts, or all of the grip on the tear tab 124-*t*.

On the left side of the tear tab 124-*t*, the outside edge 124-*e* curves longitudinally inboard 112 and laterally inward 115 and intersects the left top seal 124-*lts* at an acute angle to form the tear-propagation notch 124-*n*; the vertex of that angle is proximate to a left end of the pathway of weakness 124-*w*. The tear propagation notch 124-*n* can take any convenient size, shape and configuration, known in the art. In various embodiments, a flexible container of the present disclosure may not include a tear propagation notch. In some embodiments, instead of a tear tab and/or tear propagation notch, a flexible container of the present disclosure may include any other kind of structural feature known in the art, for facilitating removal of a removable portion. In the embodiment of FIG. 3A, the tear tab 124-*t* and the tear propagation notch 124-*n* are disposed on the left side; however, in other embodiments, a tear tab and tear propagation notch may be disposed on the right side, or even on both sides.

The removable portion 124 includes a sealed cavity 160-*c* disposed between certain film laminates within the removable portion 124, at a longitudinally inboard 112 and laterally central part of the removable portion 124. The sealed cavity 160-*c* is in fluid communication with the flow channel 159 through one or more unsealed portions between certain film laminates of the film structure 124-*s*, as described and illustrated in connection with the cross-sectional view of FIG. 6, which is taken at the section line shown in FIG. 3A, laterally across the container 100, from a point on a left portion of the outside edge 124-*e*, through a lower left part of the removable portion 124, through the sealed cavity 160-*c*, through a lower right part of the removable portion 124, and to a point on a right portion of the outside edge 124-*e*. The sealed cavity 160-*c* is sealed since the portions of the film laminates that are laterally outboard 116 and longitudinally outboard 113 from the sealed cavity 160-*c* are sealed together, together forming a cap seal 124-*cs* that surrounds the sealed cavity 160-*c* on all sides within the removable portion 124. In the embodiment of FIG. 3A, since the product space 150 is enclosed within the container 100, and the removable portion 124 has not been removed, and the sealed cavity 160-*c* is sealed, any fluent product(s) in the container 100 are hermetically sealed, with respect to the environment outside of the container 100.

The container 100 also includes instructions 124-*i* for how an end user and/or consumer should remove the removable portion 124 from the rest of the container 100. Such instructions can include directions for how and/or where to tear along the pathway of weakness 124-*w*, to remove the removable portion 124. In FIG. 3A, the instructions 124-*i* include the words "TEAR HERE" disposed on the removable portion 124 and an arrow pointing to the pathway of weakness 124-*w*; variations of this language and/or instructional graphics having the same meaning can also be used. Such instructions can also include directions for how not to remove the removable portion 124. In FIG. 3A, the instructions 124-*i* also include the words "DO NOT CUT" disposed on the removable portion 124 and an arrow pointing to the pathway of weakness 124-*w*; variations of this language and/or instructional graphics having the same meaning can also be used. Instructions for not cutting can be especially important for flexible containers of the present disclosure, since a cut that strays from a pathway of weakness and into one or more of the structural support volumes can release some or all of the expansion material(s) from inside of the volume(s), causing the structural support frame to lose some or all of its ability to support a product space. In various embodiments of flexible containers, some or all of the instructions can be disposed at locations other than a removable portion, including any convenient location on the container (such as on an upper portion of a panel) and/or on packaging provided with the flexible container.

Figure 3B:
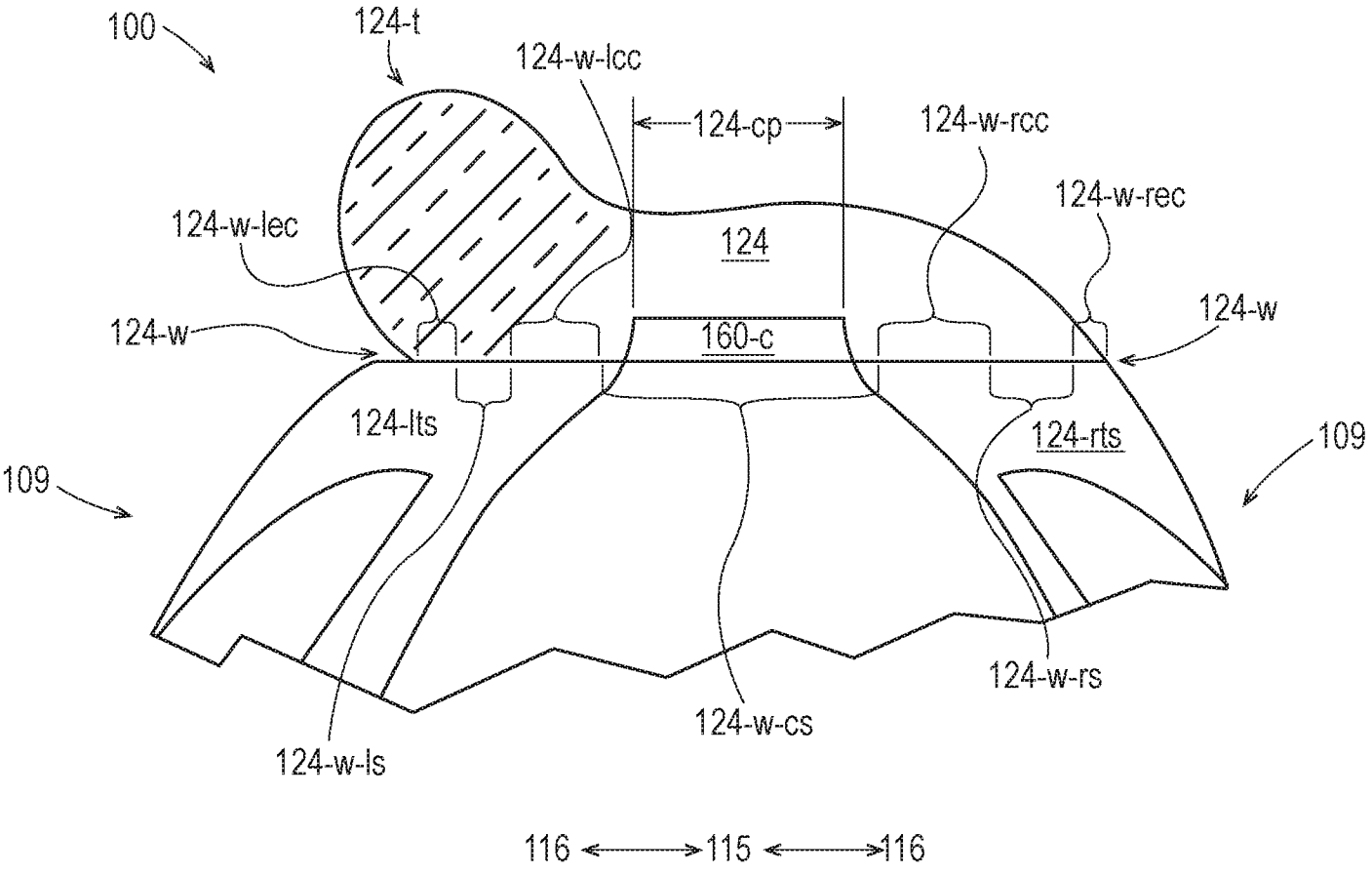
FIG. 3B illustrates the enlarged front view of FIG. 3A.

FIG. 3B illustrates the enlarged front view of the top portion of the stand up flexible container 100, as shown in FIG. 3A, and showing details of the pathway of weakness 124-*w*. In FIG. 3B, a portion of the pathway of weakness 124-*w* through the uppermost part of the left top seal 124-*lts* includes: on the left side 109, adjacent to the left end, a left end cut portion 124-*w*-*lec* extending through all of the materials in the film structure 124-*s*; adjacent to and laterally inboard 115 to the left end cut portion 124-*w*-*lec*, a left scored portion 124-*w*-*ls* that includes scores on the front and back of the film structure 124-*s*; adjacent to and laterally inboard 115 to the left scored portion 124-*w*-*ls*, a left central cut portion 124-*w*-*lcc*; and, adjacent to and laterally inboard 115 to the left central cut portion 124-*w*-*lcc*, a left portion of a central scored portion 124-*w*-*cs* that includes scores on the front and back of the film structure 124-*s*.

In FIG. 3B, a portion of the pathway of weakness 124-*w* through the uppermost part of the right top seal 124-*rts* includes: on the right side 109, adjacent to the right end, a right end cut portion 124-*w*-*rec* extending through all of the materials in the film structure 124-*s*; adjacent to and laterally inboard 115 to the right end cut portion 124-*w*-*rec*, a right scored portion 124-*w*-*rs* that includes scores on the front and back of the film structure 124-*s*; adjacent to and laterally inboard 115 to the right scored portion 124-*w*-*rs*, a right central cut portion 124-*w*-*rcc*; and, adjacent to and laterally inboard 115 to the right central cut portion 124-*w*-*rcc*, a right portion of the central scored portion 124-*w*-*cs* that includes scores on the front and back of the film structure 124-*s*.

In FIG. 3B, the portion of the pathway of weakness 124-*w* through the portion of the partially sealed central portion 124-*cp* includes a central portion of the central scored portion 124-*w*-*cs* that includes scores on the front and back of the film structure 124-*s*.

In the embodiment of FIG. 3B, each cut portion includes a single continuous cut that extends uniformly across the full extent of each cut portion, although this is not required and in various embodiments, a cut portion may include a plurality of cuts, a cut portion may include one or more non-uniform cuts, and/or a cut portion may include cuts that extend across only part or parts of the cut portion. Similarly, in the embodiment of FIG. 3B, each scored portion includes a single front score and a single back score, each of which extends uniformly across the full extent of each scored portion, although this is not required and in various embodiments, a scored portion may include one or more scores only on the front, one or more scores only on the back, or a plurality of scores on the front and/or the back, a scored portion may include one or more non-uniform scores, and/or a scored portion may include one or more scores that extend across only part or parts of the scored portion.

Each cut and score along the pathway of weakness 124-*w* performs a particular function. The left end cut portion 124-*w*-*lec* facilitates the initiation of a left-to-right tear along the pathway of weakness 124-*w*. The left scored portion 124-*w*-*ls* helps to maintain the integrity of the film structure 124-*s* by keeping the removable portion 124 attached to the container 100 until the removable portion 124 is torn off. The left central cut portion 124-*w*-*lcc* facilitates the continuation of the tear along the pathway of weakness 124-*w*, and stops short of the partially sealed central portion 124-*cp*, to maintain the hermetic seal within the sealed cavity 160-*c*. The central scored portion 124-*w*-*cs* helps to maintain the integrity of the film structure 124-*s* and, with limitations on the depths of scores, also helps to maintain the hermetic seal within the sealed cavity 160-*c* and the product space 150. The right central cut portion 124-*w*-*rcc* begins outside of the partially sealed central portion 124-*cp*, to maintain the hermetic seal within the sealed cavity 160-*c*, and facilitates the continuation of the tear along the pathway of weakness 124-*w*. The right scored portion 124-*w*-*rs* helps to maintain the integrity of the film structure 124-*s* by keeping the removable portion 124 attached until the removable portion 124 is torn off. And, the right end cut portion 124-*w*-*rec* facilitates the completion of a left-to-right tear along the pathway of weakness 124-*w*.

Each cut portion and each scored portion along the pathway of weakness can have any convenient length, such as, from 1-100 millimeters, or any integer value for millimeters between 1 and 100, or any range formed by any of these values. The scored portions along a pathway of weakness can have various widths, depths, and alignments, as described in connection with FIGS. 5A-5C. In various embodiments, the pathway of weakness 124-*w* can include any number of cuts and/or scores, in any combination, so long as the film structure 124-*s* maintains sufficient structural integrity to keep the removable portion 124 attached to the container 100 until the removable portion 124 is torn off, the sealed cavity 160-*c* remains hermetically sealed, and the pathway of weakness 124-*w* allows the removable portion 124 to be torn off. Alternatively, some or all of the cuts and/or scores can be replaced with any other features and/or structures known in the art for providing this functionality, such as etches, ablations, perforations, etc.

FIGS. 4-7 illustrate partial cross-sectional views of the film structure 124-*s* of the container 100 of FIG. 3A; these figures are not to scale, and each of these figures show film laminates with exaggerated thicknesses, to more clearly illustrate their locations and relationships. In any of the embodiments disclosed herein, any film laminate can alternatively be replaced by one or more sheets of flexible materials, each with one or more layers, including any flexible materials described herein or known in the art.

As shown in FIGS. 4-7, the film structure 124-*s* is flexible and deforms in response to compressive forces from the structure of the container, resulting in an overall shape that is continuously curved in the XZ plane, across its overall width. The degree of curvature can be reduced (or the curvature even eliminated) by using materials that are less flexible, by adding stiffening structure(s), by increasing the size of one or more adjacent structural support volumes (e.g. in a top structural support member), by reducing the effective compressive forces on the film structure 124-*s*, and/or by decreasing the overall width of the films structure 124-*s*. The degree of curvature can be increased by using materials that are more flexible, by removing stiffening structure(s), by decreasing the size of one or more adjacent structural support volumes (e.g. in a top structural support member), by increasing compressive forces on the film structure 124-*s*, and/or by increasing the overall width of the film structure 124-*s*. However, the degree of curvature can affect the relationships between the layers of film laminates within the film structure 124-*s*. In particular, a curved shape can be used to press the layers of the films structure 124-*s* against each other, to reduce and/or eliminate part, parts, or all of some or all of the gaps that tend to form at unsealed portions between the layers. In the embodiment of FIGS. 4-7, the film structure 124-*s* is curved convexly with respect to its front, however a film structure may also be curved concavely with respect to its front, or may alternatively be configured to may have little to no curvature.

Figure 4:
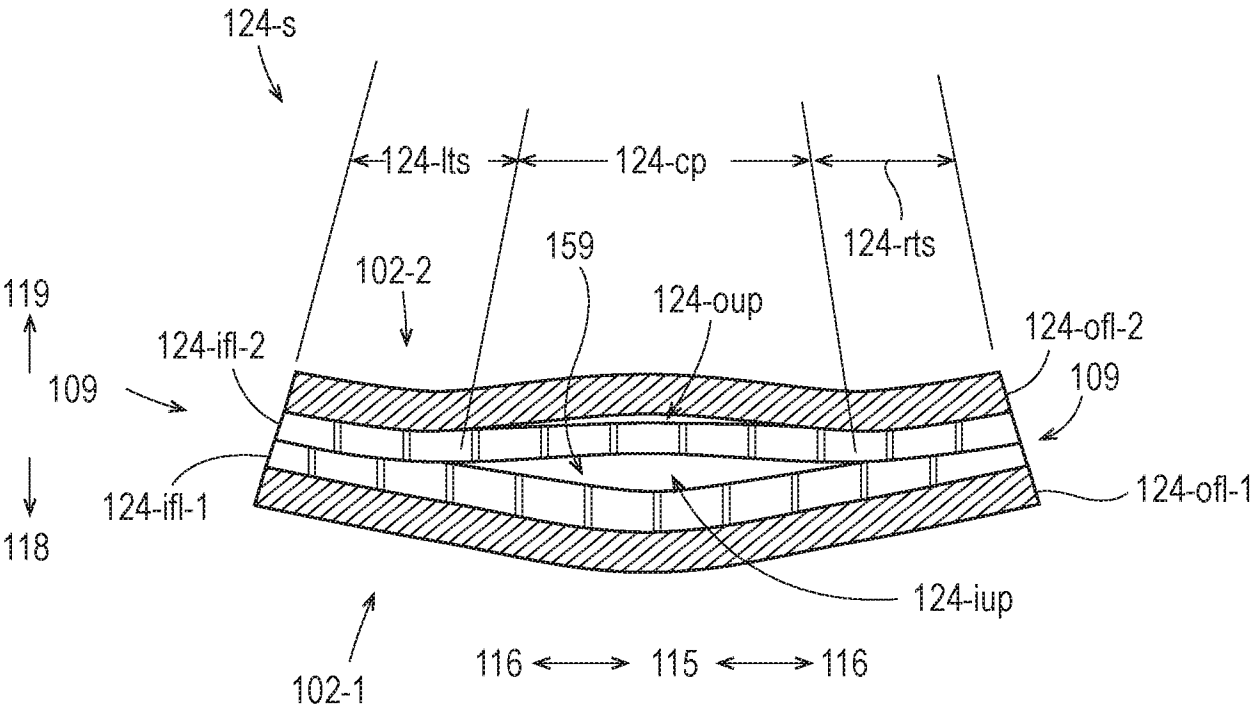
FIGS. 4-7 illustrate partial cross-sectional views of the film structure of the container of FIG. 3A.

FIG. 4 illustrates a partial cross-sectional view of the film structure 124-*s* of the container 100 of FIG. 3A, taken at the section line shown in FIG. 3A, laterally across the container 100, from the left side 109, through the middle of the left top seal 124-*lts*, through the middle of the partially sealed central portion 124-*cp*, through the middle of the right top seal 124-*rts*, and to the right side 109.

The film structure 124-*s* has a first side, which is the front 102-1, which includes a first outer film laminate 124-*ofl*-1 disposed on the front outside of the film structure 124-*s*. The front 102-1 of the film structure 124-*s* also includes a first inner film laminate 124-*ifl*-1 disposed adjacent to and inside of the first outer film laminate 124-*ofl*-1. The first outer film laminate 124-*ofl*-1 is continuously sealed to the first inner film laminate 124-*ifl*-1 in the cross-section shown in FIG. 4; however, in various embodiments, the sealing may be discontinuous, or may be some other kind of joining, direct or indirect, between part, parts, or all of the film laminates on the first side.

The film structure 124-*s* also has a second side, which is the back 102-2, which includes a second outer film laminate 124-*ofl*-2 disposed on the back outside of the film structure 124-*s*. The back 102-2 of the film structure 124-*s* also includes a second inner film laminate 124-*ifl*-2 disposed adjacent to and inside of the second outer film laminate 124-*ofl*-2. The second outer film laminate 124-*ofl*-2 is continuously sealed to the second inner film laminate 124-*ifl*-2 across the left top seal 124-*lts* and across the right top seal 124-*rts* in the cross-section shown in FIG. 4; however, in various embodiments, the sealing may be discontinuous, or may be some other kind of joining, direct or indirect, between part, parts, or all of the film laminates on the second side. The second outer film laminate 124-*ofl*-2 is not sealed or otherwise joined to the second inner film laminate 124-*ifl*-2 across the partially sealed central portion 124-*cp* in the cross-section shown in FIG. 4, resulting in a longitudinally inboard portion of an outer unsealed portion 124-*oup*, which is also a vent passage for a vent of the container 100. The film structure 124-*s* includes a curve that extends laterally across all of the outer unsealed portion 124-*oup*; however, in various embodiments, the curve of a film structure may extend over part or parts of about all, approximately all, substantially all, or nearly all of an outer unsealed portion that is a vent passage and/or vent opening.

While the vent passage is illustrated as an open gap, this illustrated state is for clarity only, is not required, and may or may not be desirable for various venting applications. In some embodiments, the vent passage may be normally open, but may open farther during venting, as a result of negative pressure from the product space and/or flow channel 159 and/or as a result of part, parts, or all of the container changing shape (i.e. attempting to return to its original shape) after dispensing and/or during venting. In other embodiments, the vent passage may be normally closed and only open during venting, as a result of negative pressure from the product space and/or flow channel 159 and/or as a result of part, parts, or all of the container changing shape after dispensing and/or during venting. In various embodiments, part, parts, or all of the film laminates on the second side may be joined, directly or indirectly, within the partially sealed central portion 124-*cp*, so long as air can pass between the laminates, for the purpose of venting. As part of the venting structures of the container 100, the vent passage between the second outer film laminate 124-*ofl*-2 and the second inner film laminate 124-*ifl*-2 is in fluid communication with the product space 150 of the container 100; for example, a plurality of pin holes can be made through the second inner film laminate 124-*ifl*-2 in the headspace portion of the product volume 150, such that ambient air (from the environment outside of the container) can flow into the vent passage, through the pin holes, and into the headspace of the product volume. In various embodiments, this fluid communication can be direct or indirect, permanent or temporary, continuous or intermittent, through any kind of opening(s), configured in any convenient way known in the art. In alternative embodiments, an outer unsealed portion may be omitted, and a product space of a flexible container can be vented directly through a dispenser, or through a vent disposed apart from the structure that includes a dispenser, or not vented at all.

In the film structure 124-*s*, the second inner film laminate 124-*ifl*-2 is disposed adjacent to the first inner film laminate 124-*ifl*-1. The second inner film laminate 124-*ifl*-2 is continuously sealed to the first inner film laminate 124-*ifl*-1 across the left top seal 124-*lts* and across the right top seal 124-*rts* in the cross-section shown in FIG. 4; however, in various embodiments, the sealing may be discontinuous, or may be some other kind of joining, direct or indirect, between part, parts, or all of the inner film laminates. The second inner film laminate 124-*ifl*-2 is not sealed or otherwise joined to the first inner film laminate 124-*ifl*-2 across the partially sealed central portion 124-*cp* in the cross-section shown in FIG. 4, resulting in a longitudinally inboard portion of an inner unsealed portion 124-*iup*, which is also the flow channel 159 for the container 100. The film structure 124-*s* includes a curve that extends laterally across all of the inner unsealed portion 124-*iup*; however, in various embodiments, the curve of a film structure may extend over part or parts of about all, approximately all, substantially all, or nearly all of an inner unsealed portion that is a flow channel and/or dispenser.

While the inner unsealed portion 124-*iup* is illustrated as an open gap, this illustrated state is for clarity only, is not required, and may or may not be desirable for various product dispensing applications. In some embodiments, the inner unsealed portion 124-*iup* may be normally open, but may open farther during dispensing (e.g. upon application of an externally compressing squeeze force from a user to a product space of the container), as a result of positive pressure from the product space and/or flow channel 159 and/or as a result of part, parts, or all of the container changing shape during dispensing. In other embodiments, the inner unsealed portion 124-*iup* may be normally closed and only open during dispensing (upon application of a squeeze force from a user to the product space of the container), as a result of positive pressure from the product space and/or flow channel 159 and/or as a result of part, parts, or all of the container changing shape during dispensing; after the dispensing the normally closed inner unsealed portion 124-*iup* automatically returns to its closed condition (wherein the closed condition may also be sealed). In various embodiments, part, parts, or all of the inner film laminates may be joined, directly or indirectly, within the partially sealed central portion 124-*cp*, so long as fluent product can pass between the inner film laminates, for the purpose of dispensing. As part of the dispensing structures of the container 100, the inner unsealed portion 124-*iup* (i.e. the flow channel 159) between the first inner film laminate 124-*ifl*-1 and the second inner film laminate 124-*ifl*-2 is in direct fluid communication with the product space 150 of the container 100. In various embodiments, this fluid communication can be direct or indirect, permanent or temporary, continuous or intermittent, configured in any convenient way known in the art.

In the embodiment of FIG. 4, the outer unsealed portion 124-*oup* and the inner unsealed portion 124-*iup* are each laterally centered on the film structure 124-*s*; however this configuration is not required, and in various embodiments, these unsealed portions can be partially or fully laterally offset within the film structure 124-*s* and/or from each other. Each unsealed portion along the pathway of weakness can have any convenient width, such as, from 1-100 millimeters, or any integer value for millimeters between 1 and 100, or any range formed by any of these values. In the embodiment of FIG. 4, the outer unsealed portion 124-*oup* and the inner unsealed portion 124-*iup* have widths that are co-extensive with each other; however this configuration is not required, and in various embodiments, either of these unsealed portions can be wider than the other.

Figure 5A:
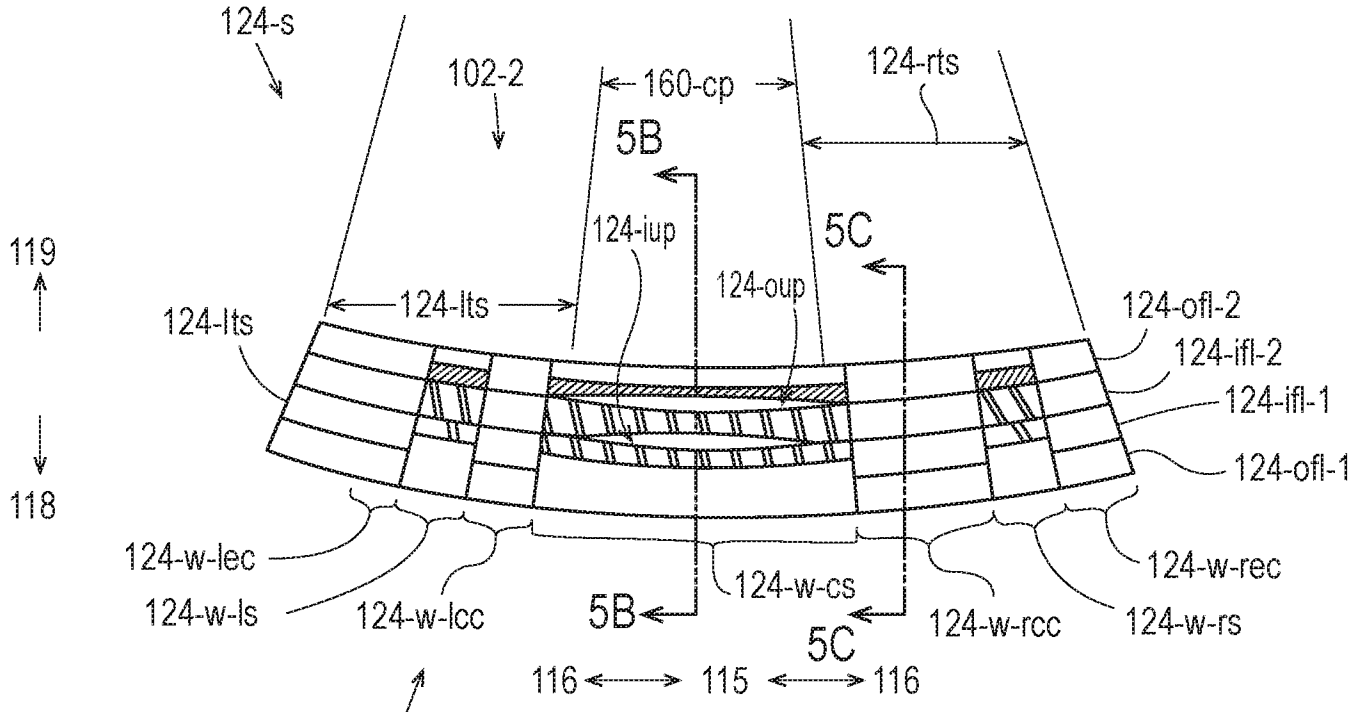

FIG. 5A illustrates a partial cross-sectional view of the film structure 124-*s* of the container 100 of FIG. 3A, taken at the section line shown in FIG. 3A, along the pathway of weakness 124-*w*, laterally across the container 100, from the left side 109, through the uppermost part of the left top seal 124-*lts*, through a portion of the partially sealed central portion 124-*cp*, through the uppermost part of the right top seal 127-*rts*, and to the right side 109. The cross-section of FIG. 5A is configured in the same way as the cross-section of FIG. 4, except as otherwise described below.

In the cross-section of FIG. 5A, the portion of the left top seal 124-*lts* that is exposed by the tear-propagation notch 124-*n* as well as the cut portions are shown as a top view across all layers, and not as cross-section, since those portions have an outside edge along the pathway of weakness 124-*w*, and are not cut by the section line forming the cross-sectional view; these cut portions include: the left end cut portion 124-*w*-*lec*, the left central cut portion 124-*w*-*lcc*, the right central cut portion 124-*w*-*rcc*, and the right end cut portion 124-*w*-*rec*.

Also, in the cross-section of FIG. 5A, outer portions of certain layers in the scored portions are shown as recessed cut-aways, and not as cross-section, since those portions have been removed along the pathway of weakness 124-*w*, and are not cut by the section line forming the cross-sectional view; these scored portions include: the left scored portion 124-*w*-*ls*, the central scored portion 124-*w*-*cs*, and the right scored portion 124-*w*-*rs*.

Since the cross-section of FIG. 5A is taken along the pathway of weakness 124-*w*, when the removable portion 124 is torn off of the container 100, the outer unsealed portion 124-*oup* is disposed at an outermost part of the vent passage and thus forms a vent opening. The vent passage includes a plurality of stand-offs disposed between the second inner film laminate 124-*ifl*-2 and the second outer film laminate 124-*ofl*-2, within the outer unsealed portion 124-*oup*, as described and illustrated with respect to FIG. 5B. And, since the cross-section of FIG. 5A it taken along the pathway of weakness 124-*w*, when the removable portion 124 is torn off of the container 100, the inner unsealed portion 124-*iup* is disposed at an outermost part of the flow channel 159 and thus forms the opening for the dispenser 160. The dispenser 160 includes a plurality of stand-offs disposed between the first inner film laminate 124-*ifl*-1 and the second inner film laminate 124-*ifl*-2, within the inner unsealed portion 124-*iup*, as described and illustrated with respect to FIG. 5B.

Figure 5C:
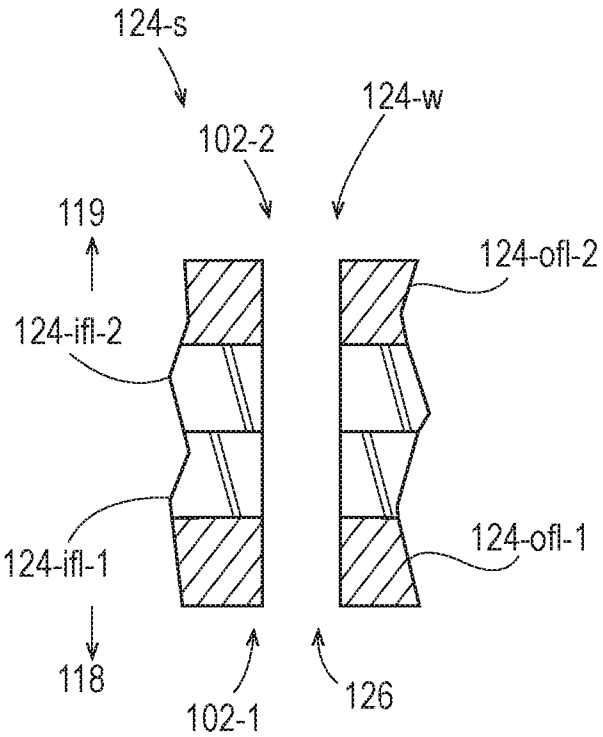
Figure 5B:
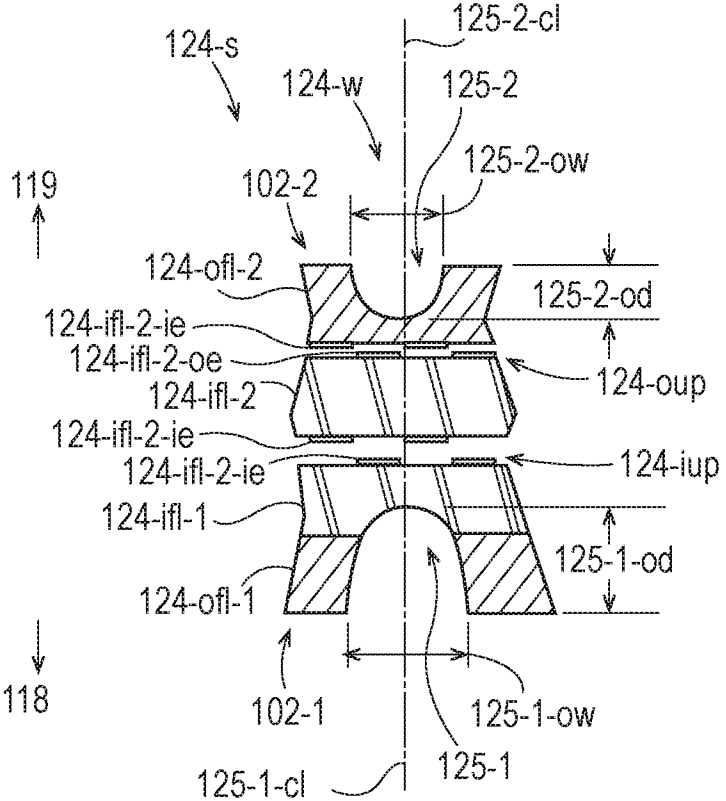

FIG. 5B illustrates a partial cross-sectional view of the film structure 124-*s* of the container 100 of FIG. 5A, taken at the section line shown in FIG. 5A, along the pathway of weakness 124-*w*, within the central scored portion 124-*w*-*cs*, through the depth of the film structure 124-*s*, from the front 102-1, through all of the film laminates, and to the back 102-2. In the cross-section of FIG. 5B, the pathway of weakness 124-*w* and portions of the film laminates immediately adjacent to the pathway of weakness 124-*w* are shown. Since the cross-section of FIG. 5B is taken within the central scored portion 124-*w*-*cs*, the film structure 124-*s* includes a front score 125-1 on the front 102-1 and a back score 125-2 on the back 102-2.

The front score 125-1 has a front score overall width 125-1-*ow* measured across an outer surface of the first outer film laminate 124-*ofl*-1 and perpendicular to the pathway of weakness 124-*w*, wherein the front score overall width 125-1-*ow* is centered on a front score centerline 125-1-*cl*. The front score 125-1 also has a front score overall depth 125-1-*od* measured from and perpendicular to an outer surface of the first outer film laminate 124-*ofl*-1 to a deepest depth within the front score 125-1. The front score 125-1 extends all the way through the first outer film laminate 124-*ofl*-1 and only partway through the first inner film laminate 124-*ifl*-1; for example, the front score 125-1 may extend 5-95% through the first inner film laminate 124-*ifl*-1, or any percentage value in increments of 5% between 5% and 95%, or an any range formed by any of these values. In alternative embodiments, a front score may extend only partway through the first outer film laminate 124-*ofl*-1; for example, a first score may extend 5-95% through a first outer film laminate, or any percentage value in increments of 5% between 5% and 95%, or an any range formed by any of these values. The front score overall depth 124-1-*od* is limited, such that the front score 125-1 stops short of the inner unsealed portion 124-*iup*, to maintain the hermetic seal within the sealed cavity 160-*c* and the product space 150. However, in embodiments where a hermetic seal is not required, the front score 125-1 may extend through the first inner film laminate 124-*ifl*-1. In alternative embodiments, a front score may be omitted from the central scored portion 124-*w*-*cs*.

The back score 125-2 has a back score overall width 125-2-*ow* measured across an outer surface of the second outer film laminate 124-*ofl*-2 and perpendicular to the pathway of weakness 124-*w*, wherein the back score overall width 125-2-*ow* is centered on a back score centerline 125-2-*cl*. The back score 125-2 has a back score overall depth 125-2-*od* measured from and perpendicular to an outer surface of the second outer film laminate 124-*ofl*-2 to a deepest depth within the back score 125-2. The back score 125-2 extends only partway through the second outer film laminate 124-*ofl*-2; for example, the back score 125-2 may extend 5-95% through the second outer film laminate 124-*ofl*-2, or any percentage value in increments of 5% between 5% and 95%, or an any range formed by any of these values. The back score overall depth 124-2-*od* is limited, such that the back score 125-2 stops short of the outer unsealed portion 124-*oup*, to maintain the hermetic seal within the sealed cavity 160-*c* and the product space 150. However, in embodiments where an outer unsealed portion is omitted, the back score 125-2 may extend all the way through the second outer film laminate 124-*ofl*-2, and optionally, partway through the second inner film laminate 124-*ifl*-2; for example, a back score may extend 5-95% through a second inner film laminate, or any percentage value in increments of 5% between 5% and 95%, or an any range formed by any of these values. And, in embodiments where a hermetic seal is not required, the back score 125-2 may also extend all the way through the second inner film laminate 124-*ifl*-2. In alternative embodiments, a back score may be omitted from the central scored portion 124-*w*-*cs*.

Any of the scored portions disclosed herein can be configured according to any of the embodiments for scoring disclosed herein, including a front score and/or back score configured according to any of the following. A score can be applied by any kind of mechanical apparatus, such as a scoring knife or a die; a score can be applied by any kind of thermal apparatus, such as a heated blade; a score can be applied by any kind of directed energy apparatus, such as a laser; a score can be applied by any kind of energy-field apparatus, such as a microwave emitter. An example of a laser useful for cutting and scoring plastic film laminates is a sealed carbon dioxide type laser, having a power range of 100 to 1000 watts, and a laser wavelength of 9.4 microns; such lasers are available from various suppliers, such as an LPM1000 module, available in LASERSHARP systems from LasX Industries, Inc. of White Bear Lake, Minn., United States. These processes and equipment can be set up and adjusted to create scores of a particular width and depth along one or more selected scored portions of a pathway of weakness.

Alternatively or additionally, one or more materials of a film structure can be selected, designed, and/or modified to cause particular interactions with scoring processes and equipment, to create scores having particular widths and/or depths.

As a first example, particular plastic materials can be included in or excluded from various parts of a film structure, to tune the degree of energy absorption in the materials, as desired, based on their energy absorption properties for particular forms of energy. In general, for laser wavelengths of about 9-11 microns, polyamides (such as Nylon), polyvinyl chlorides (PVCs), and polyethylene terephthalates (PETs) have relatively higher degrees of laser energy absorption, while low density polyethylenes (such as LLDPE) have relatively lower degrees of laser energy absorption, when considered in their raw forms (without additives).

As a second example, particular energy-receptive additives can be included in/on or excluded from various parts of a film structure, to tune the degree of energy absorption in the materials, as desired, based on their energy absorption properties for particular forms of energy. Where laser cutting or scoring is desired, one or more energy-receptive additives can be added into and/or onto a film laminate and/or its components, to enhance the effectiveness of the laser energy in removing material from such locations. Such additives can be added in by mixing them into a masterbatch of resin prior to forming the film and/or film laminate. Such additives can also be added onto a film and/or film laminate by depositing (e.g. printing or coating) such additives onto locations for cutting or scoring; such targeted depositions may require fewer additives, resulting in cost savings, and may enable the use of an energy field apparatus instead of a directed energy apparatus. Where laser cutting or scoring is not desired, energy-receptive additives can be excluded. Where relatively more or less cutting or scoring is desired, relatively more or fewer energy-receptive additives can be included in or on the target materials, to tune the degree of energy absorption in the materials.

Some examples of energy-receptive additives, which can be added into resin masterbatches for making plastic film/laminates, and are known in the art, include: "natural silicates . . . , silica, calcium carbonate, barium sulphate, aluminum hydrate, and metallic hydroxysulphates . . . . boron-oxygen compounds . . . boric acid, alkaline and alkaline earth borates, aluminum borate, zinc borate, and andhydrous borax" as disclosed by U.S. Pat. No. 4,559,381 (col. 1, lines 42-44; col. 3, lines 1-3) to Tapia, et al. entitled "Polymeric Covering Materials for Growing Plants or Crops." Other additives, commonly included in plastic films, to provide various functions, can also act as energy-receptive additives, such as: "fillers, colourants, release agents, UV retardants, flame retardants, etc." as disclosed on page 1622 of the Handbook of Laser Technology an Applications; Volume III Applications, by Colin Webb and Julian Jones (Institute of Physics Publishing, 104). Films and/or film laminates that are laser susceptible and/or that include energy receptive additives can also be obtained from various film suppliers, such as Mondi Gronau GmbH, of Gronau, Germany.

In the embodiment of FIG. 5B, the first outer film laminate 124-*ofl*-1 includes one or more energy-receptive additives and the first inner film laminate 124-*ifl*-1 does not include any energy-receptive additives. However, in various embodiments, the first outer film laminate 124-*ofl*-1 may include relatively more energy-receptive additives and the first inner film laminate 124-*ifl*-1 may include relatively fewer energy-receptive additives. Alternatively, any approach described herein may be used, such that the first outer film laminate 124-*ofl*-1 has a first outer degree of energy-absorption, and the first inner film laminate 124-*ifl*-1 has a first inner degree of energy-absorption, wherein the first inner degree is less than the first outer degree.

In the embodiment of FIG. 5B, the second outer film laminate 124-*ofl*-2 includes one or more energy-receptive additives and the second inner film laminate 124-*ifl*-2 does not include any energy-receptive additives. Alternatively, any approach described herein may be used, such that the second outer film laminate 124-*ofl*-2 has a second outer degree of energy-absorption, and the second inner film laminate 124-*ifl*-2 has a second inner degree of energy-absorption, wherein the second inner degree is less than the second outer degree.

Any of the cuts or scores described herein, for use along a pathway of weakness can be configured with an overall width of 0.05-1.5 millimeters, or any value between 0.05 and 1.5 millimeters in increments of 0.05 millimeters, or any range formed by any of these values. Any of the cuts or scores described herein, for use along a pathway of weakness can be configured with an overall depth of 0.05-10 millimeters, or any value between 0.05 and 10 millimeters in increments of 0.05 millimeters, or any range formed by any of these values.

In the embodiment of FIG. 5B, the front score 125-1 is fully aligned with the back score 125-2, since the front score centerline 125-1-*cl* is aligned with the back score centerline 125-2-*cl*. However, in various embodiments, a front score centerline may be offset from a back score centerline by 0.0-2.0 millimeters, or any value between 0.0 and 2.0 millimeters in increments of 0.1 millimeters, or any range formed by any of these values. In the embodiment of FIG. 5B, the front score 125-1 fully overlaps with the back score 125-2, along the pathway of weakness 124-*w*, since all of the front score overall width 125-1-*ow* is co-extensive with all of the back score overall width 125-2-*ow* centerline, when taken through the depth of the film structure 124-*s*. In various embodiments, a front score may only partially overlap with a back score in part, parts, or all of a scored portion. And, in some embodiments, a front score may not overlap with a back score, but in part, parts, or all of a scored portion, the scores may be offset from each other by an offset distance of 0.0-5.0 millimeters, or any value between 0.0 and 5.0 millimeters in increments of 0.1 millimeters, or any range formed by any of these values.

While the embodiment of FIG. 5B relates to the central scored portion 124-*w-cs*, the same scoring can also be applied to the left scored portion 124-*w-ls* and to the right scored portion 124-*w-rs* of the pathway of weakness 124-*w*; alternatively, any variations in scoring disclosed herein can also be applied to these scored portions.

As shown in FIG. 5B, the vent passage includes a plurality of vent stand-offs disposed between the second inner film laminate 124-*ifl*-2 and the second outer film laminate 124-*ofl*-2, within the outer unsealed portion 124-*oup*. The presence of vent stand-offs between adjacent layers of material in a vent and/or vent passage can at least assist in providing (continuous or intermittent) separation between the layers and thus can improve the flow of air through the vent and/or vent passage. A first plurality of vent stand-offs 124-*ofl*-2-*ie* is disposed on the inward facing side of the second outer film laminate 124-*ofl*-2. A second plurality of vent stand-offs 124-*ifl*-2-*oe* is disposed on the outward facing side of the second inner film laminate 124-*ifl*-2.

In some embodiments, some or all of the stand-offs in the first plurality of vent stand-offs 124-*ofl*-2-*ie* may be configured to align with some or all of the stand-offs in the second plurality of vent stand-offs 124-*ifl*-2-*oe*, such that at least some opposing vent stand-offs partially or fully contact each other. In other embodiments, some or all of the stand-offs in the first plurality of vent stand-offs 124-*ofl*-2-*ie* may be configured to be offset from some or all of the stand-offs in the second plurality of vent stand-offs 124-*ifl*-2-*oe*, such that at least some opposing vent stand-offs do not contact each other.

In various embodiments, vent stand-offs may be disposed at a distal end of a vent passage, adjacent to a vent or may be disposed over part, parts, or about all, or approximately all, or substantially all, or nearly all, or all of the portions of the materials (e.g. layers of flexible material) that form the vent passage. In some embodiments, vent stand-offs may be disposed on a laterally central portion of the vent passage. In alternative embodiments, the first plurality of vent stand-offs 124-*ofl*-2-*ie* may be omitted, the second plurality of vent stand-offs 124-*ifl*-2-*oe* may be omitted, or both pluralities may be omitted.

Also as shown in FIG. 5B, the dispenser includes a plurality of dispenser stand-offs disposed between the first inner film laminate 124-*ifl*-1 and the second inner film laminate 124-*ifl*-2, within the inner unsealed portion 124-*iup*. The presence of dispenser stand-offs between adjacent layers of material in a dispenser and/or flow channel can at least assist in providing (continuous or intermittent) separation between the layers and thus can improve the flow of air through the dispenser when the dispenser is used for venting. The presence of dispenser stand-offs between adjacent layers of material in a dispenser and/or flow channel can also be used to at least assist in controlling the flow of fluent product through the dispenser when dispensing. A first plurality of dispenser stand-offs 124-*ifl*-1-*ie* is disposed on the inward facing side of the first inner film laminate 124-*ifl*-1. A second plurality of dispenser stand-offs 124-*ifl*-2-*ie* is disposed on the inward facing side of the second inner film laminate 124-*ifl*-2. In various embodiments, dispenser stand-offs may be disposed at a distal end of a flow channel, adjacent to a dispenser or may be disposed over part, parts, or about all, or approximately all, or substantially all, or nearly all, or all of the portions of the materials that form the flow channel. In some embodiments, dispenser stand-offs may be disposed on a laterally central portion of the flow channel. In alternative embodiments, the first plurality of dispenser stand-offs 124-*ifl*-1-*ie* may be omitted, the second plurality of dispenser stand-offs 124-*ifl*-2-*ie* may be omitted, or both pluralities may be omitted.

In some embodiments, some or all of the stand-offs in the first plurality of dispenser stand-offs 124-*ifl*-1-*ie* may be configured to align with some or all of the stand-offs in the second plurality of dispenser stand-offs 124-*ifl*-2-*ie*, such that at least some opposing dispenser stand-offs partially or fully contact each other. In other embodiments, some or all of the stand-offs first plurality of dispenser stand-offs 124-*ifl*-1-*ie* may be configured to be offset from some or all of the stand-offs in the second plurality of dispenser stand-offs 124-*ifl*-2-*ie*, such that at least some opposing dispenser stand-offs do not contact each other.

Any of the stand-offs described herein can be configured in various ways, as described below. A standoff may be integral with the laminate on which the standoff is disposed, or may be formed by one or more separate elements or materials joined to the laminate. As an example, a standoff may be an embossment with one or more raised portions above an outer surface of a flexible material, with one or more recessed portions below an outer surface of a recessed material, or with a combination of raised and recessed portions. An embossment can be made by mechanical embossing, thermoforming, or laser engraving, or may be raised print added by printing, or may be layers of additional material attached to the laminate, or may be any other suitable form of stand-off known in the art.

Each stand-off can have any convenient size and shape. A stand-off can have an overall height that provides a particular separation between the unsealed layers; for example a stand-off can have an overall height that provides a separation of 0.0-2.0 millimeters, or any value between 0.0 and 2.0 millimeters in increments of 0.01 millimeters, or any range formed by any of these values. In various embodiments, the separation can be uniform or variable across the unsealed portion. A stand-off can have any convenient shape such as circular, oval, triangular, rectangular, squarish, star-shaped, etc., or any shape known in the art, or combinations of any of these shapes. Each plurality of stand-offs can have any convenient pattern and distribution.

FIG. 5C illustrates a partial cross-sectional view of the film structure 124-*s* of the container 100 of FIG. 5A, taken at the section line shown in FIG. 5A, along the pathway of weakness 124-*w*, within the right central cut portion 124-*w-rcc*, through the depth of the film structure 124-*s*, from the front 102-1, through all of the film laminates, and to the back 102-2. In the cross-section of FIG. 5B, the pathway of weakness 124-*w* and portions of the film laminates immediately adjacent to the pathway of weakness 124-*w* are shown. The cross-section of FIG. 5C is taken within the right central cut portion 124-*w-rcc*, the film structure 124-*s* includes a cut 126 through the film structure 124-*s* from the front 102-1 to the back 102-2. The cut 126 of the right central cut portion 124-*w-rcc*, as well as cuts of the left end cut portion 124-*w-lec*, the left central cut portion 124-*w-lcc*, and the right end cut portion 124-*w-rec*, can be made any way described herein or known in the art.

Figure 6:
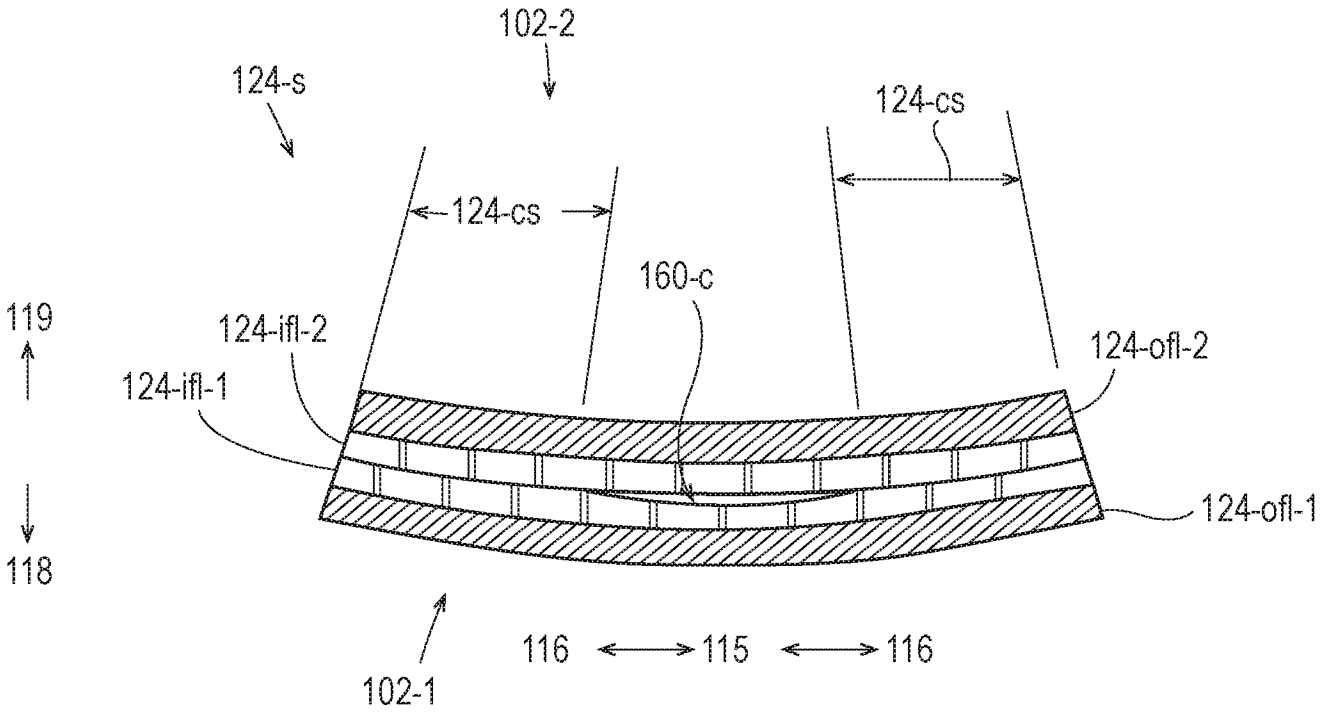

FIG. 6 illustrates a partial cross-sectional view of the film structure 124-*s* of the container 100 of FIG. 3A, taken at the section line shown in FIG. 3A, laterally across the container 100, from a point on a left portion of the outside edge 124-*e*, through a lower left part of the removable portion 124 that is part of the cap seal 124-*cs*, through the sealed cavity 160-*c*, through a lower right part of the removable portion 124 that is part of the cap seal 124-*cs*, and to a point on a right portion of the outside edge 124-*e*. The cross-section of FIG. 6 is configured in the same way as the cross-section of FIG. 5A, except as otherwise described below.

In the cross-section of FIG. 6, there is no unsealed portion between the second outer film laminate 124-*ofl*-2 and the second inner film laminate 124-*ifl*-2, since the outer unsealed portion 124-*oup* of FIG. 5A is the vent opening and the vent passage does not extend above the pathway of weakness 124-*w*. The second outer film laminate 124-*ofl*-2 is continuously sealed to the second inner film laminate 124-*ifl*-2 in the laterally central portion between the portions of the cap seal 124-*cs* in the cross-section shown in FIG. 6; however, in various embodiments, the sealing may be discontinuous, or may be some other kind of joining, direct or indirect, between part, parts, or all of the film laminates on the second side. In alternative embodiments, the vent passage may extend above pathway of weakness 124-*w*, with an unsealed portion between the second outer film laminate 124-*ofl*-2 and the second inner film laminate 124-*ifl*-2.

The cross-section of FIG. 6 shows a portion of the sealed cavity 160-*c*, which is disposed between the first inner film laminate 124-*ifl*1 and the second inner film laminate 124-*ifl*-2 within the removable portion 124, at a laterally central part of the removable portion 124, between a left part of the cap seal 124-*cs* and a right part of the cap seal 124-*cs*. The sealed cavity 160-*c* is configured in the same way as the inner unsealed portion 124-*iup* of FIG. 5A, and can be configured in according to any alternative embodiments of the inner unsealed portion 124-*iup* of FIG. 5A. The sealed cavity 160-*c* is in fluid communication with the flow channel 159 through the inner unsealed portion 124-*iup* of FIG. 5A. However, the sealed cavity 160-*c* is hermetically sealed, with respect to the environment outside of the container 100.

Figure 7:
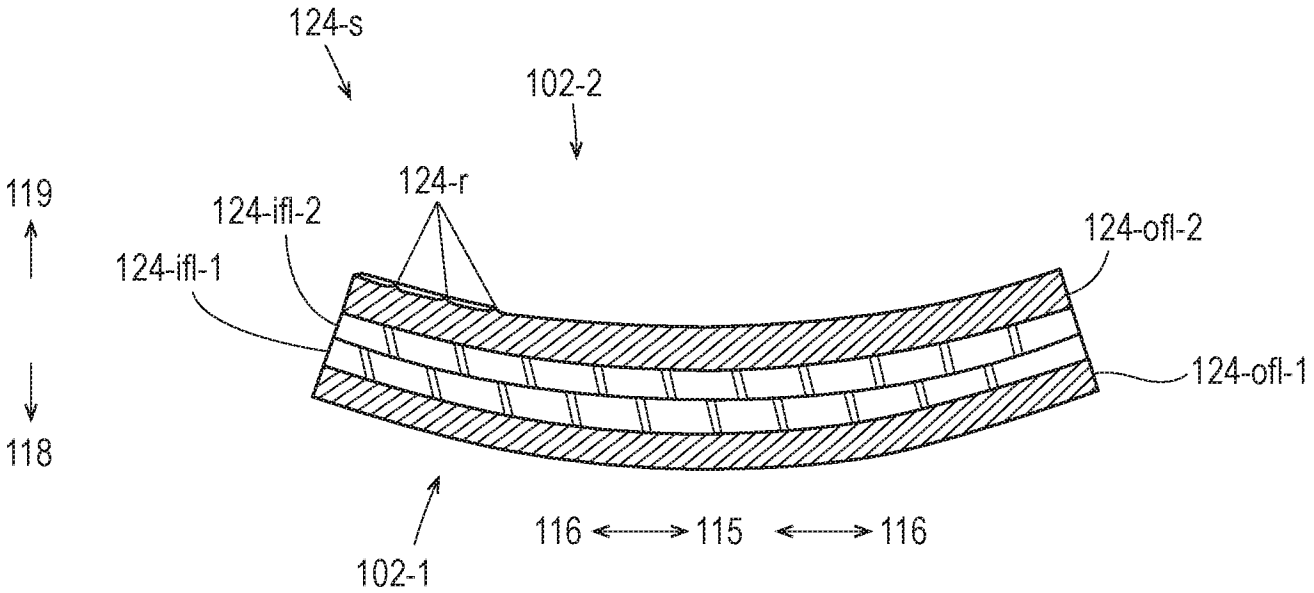

FIG. 7 illustrates a partial cross-sectional view of the film structure 124-*s* of the container 100 of FIG. 3A, taken at the section line shown in FIG. 3A, above the sealed cavity 160-*c*, laterally across the removable portion 124, from a point on a left portion of the outside edge 124-*e* to a point on a right portion of the outside edge 124-*e*. In the cross-section of FIG. 7, there is no unsealed portion between any of the film laminates. The first inner film laminate 124-*ifl*-1 is continuously sealed to the second inner film laminate 124-*ifl*-2 across the cross-section shown in FIG. 6; however, in various embodiments, the sealing may be discontinuous, or may be some other kind of joining, direct or indirect, between part, parts, or all of the film laminates on the second side. In FIG. 7, on the left side of the cross-section, the embossed ridges 124-*r* are shown.

Figure 8:
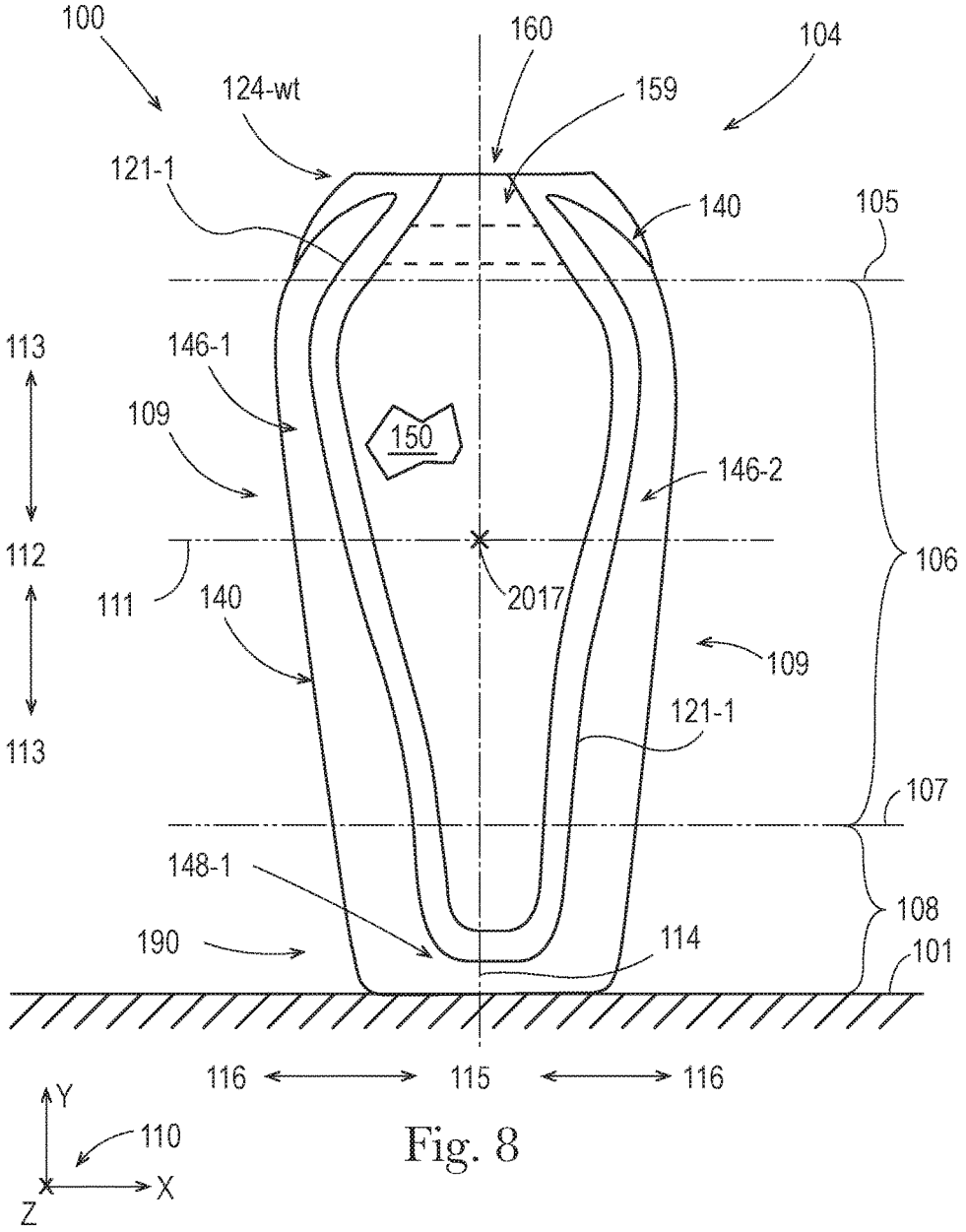
FIG. 8 illustrates the container of FIG. 1A when the removable portion is removed, along a pathway of weakness, so the container can dispense fluent products.

FIG. 8 illustrates the container 100 when the removable portion 124 is removed, along the pathway of weakness 124-*w*, so the container 100 can dispense fluent product(s) from the product space 150 through the flow channel 159 then through the dispenser 160, to the environment outside of the container 100.

Part, parts, or all of any of the embodiments disclosed herein also can be combined with part, parts, or all of other embodiments known in the art of containers for fluent products, so long as those embodiments can be applied to flexible containers, as disclosed herein.

The packages described herein, may be used across a variety of industries for a variety of products. For example, any embodiment of a package, as described herein may be used for receiving, containing, storing, and/or dispensing any fluent product in the consumer products industry, including any of the following products, any of which can take any product form described herein or known in the art: baby care products (e.g. soaps, shampoos, and lotions); beauty care products for cleaning, treating, beautifying, and/or decorating human hair (e.g. hair shampoos, hair conditioners, hair dyes, hair colorants, hair repair products, hair growth products, hair removal products, hair minimization products, etc.); beauty care products for cleaning, treating, beautifying, and/or decorating human skin (e.g. soaps, body washes, body scrubs, facial cleansers, astringents, sunscreens, sun block lotions, lip balms, cosmetics, skin conditioners, cold creams, skin moisturizers, antiperspirants, deodorants, etc.); beauty care products for cleaning, treating, beautifying, and/or decorating human nails (e.g. nail polishes, nail polish removers, etc.); grooming products for cleaning, treating, beautifying, and/or decorating human facial hair (e.g. shaving products, pre-shaving products, after shaving products, etc.); health care products for cleaning, treating, beautifying, and/or decorating human oral cavities (e.g. toothpaste, mouthwash, breath freshening products, anti-plaque products, tooth whitening products, etc.); health care products for treating human health conditions (e.g. medicines, medicaments, pharmaceuticals, vitamins, nutraceuticals, nutrient supplements (for calcium, fiber, etc.), cough treatment products, cold remedies, lozenges, treatments for respiratory and/or allergy conditions, pain relievers, sleep aids, gastrointestinal treatment products (for heartburn, upset stomach, diarrhea, irritable bowel syndrome, etc.), purified water, treated water, etc.); fabric care products for cleaning, conditioning, refreshing and/or treating fabrics, clothes, and/or laundry (e.g. laundry detergents, fabric conditioners, fabric dyes, fabric bleaches, etc.); dish care products for home, commercial, and/or industrial use (e.g. dish soaps and rinse aids for hand-washing and/or machine washing); cleaning and/or deodorizing products for home, commercial, and/or industrial use (e.g. soft surface cleaners, hard surface cleaners, glass cleaners, ceramic tile cleaners, carpet cleaners, wood cleaners, multi-surface cleaners, surface disinfectants, kitchen cleaners, bath cleaners (e.g. sink, toilet, tub, and/or shower cleaners), appliance cleaning products, appliance treatment products, car cleaning products, car deodorizing products, air cleaners, air deodorizers, air disinfectants, etc.), and the like.

Although the present disclosure describes its embodiments with respect to consumer products, they can also be similarly applied outside of the consumer products industry, including: the areas of home, commercial, and/or industrial, building and/or grounds, construction and/or maintenance; the food and beverage industry; the medical industry, in the areas of medicines, medical devices, and medical treatment; and all industries that use internal combustion engines (such as the transportation industry, and the power equipment industry, the power generation industry, etc.).

DEFINITIONS

As used herein, the term "about" modifies a particular value, by referring to a range equal to the particular value, plus or minus twenty percent (+/−20%). For any of the embodiments of flexible containers, disclosed herein, any disclosure of a particular value, can, in various alternate embodiments, also be understood as a disclosure of a range equal to about that particular value (i.e. +/−20%).

As used herein, the term "approximately" modifies a particular value, by referring to a range equal to the particular value, plus or minus fifteen percent (+/−15%). For any of the embodiments of flexible containers, disclosed herein, any disclosure of a particular value, can, in various alternate embodiments, also be understood as a disclosure of a range equal to approximately that particular value (i.e. +/−15%).

As used herein, the term "atmospheric pressure" refers to an absolute pressure of 1 atmosphere.

As used herein, when referring to a flexible container, the term "bottom" refers to the portion of the container that is located in the lowermost 30% of the overall height of the container, that is, from 0-30% of the overall height of the container. As used herein, the term bottom can be further limited by modifying the term bottom with a particular percentage value, which is less than 30%. For any of the embodiments of flexible containers, disclosed herein, a reference to the bottom of the container can, in various alternate embodiments, refer to the bottom 25% (i.e. from 0-25% of the overall height), the bottom 20% (i.e. from 0-20% of the overall height), the bottom 15% (i.e. from 0-15% of the overall height), the bottom 10% (i.e. from 0-10% of the overall height), or the bottom 5% (i.e. from 0-5% of the overall height), or any integer value for percentage between 0% and 30%.

As used herein, the term "directly connected" refers to a configuration wherein elements are attached to each other without any intermediate elements therebetween, except for any means of attachment (e.g. adhesive).

As used herein, when referring to a flexible container, the term "dispenser" refers to a structure configured to dispense fluent product(s) from a product space and/or from a mixing volume to the environment outside of the container. For any of the flexible containers disclosed herein, any dispenser can be configured in any way disclosed herein or known in the art, including any suitable size, shape, and flow rate. For example, a dispenser can be a push-pull type dispenser, a dispenser with a flip-top cap, a dispenser with a screw-on cap, a rotatable type dispenser, dispenser with a cap, a pump type dispenser, a pump spray type dispenser, a trigger spray type dispenser, a straw dispenser, a flip up straw dispenser, a straw dispenser with bite valve, a dosing dispenser, etc. A dispenser can be a parallel dispenser, providing multiple flow channels in fluid communication with multiple product spaces, wherein those flow channels remain separate until the point of dispensing, thus allowing fluent products from multiple product spaces to be dispensed as separate fluent products, dispensed together at the same time. A dispenser can be a mixing dispenser, providing one or more flow channels in fluid communication with multiple product spaces, with multiple flow channels combined before the point of dispensing, thus allowing fluent products from multiple product spaces to be dispensed as the fluent products mixed together. As another example, a dispenser can be formed by a frangible opening. As further examples, a dispenser can utilize one or more valves and/or dispensing mechanisms disclosed in the art, such as those disclosed in: U.S. provisional patent application 62/157,766 filed May 6, 2015 entitled "Methods of Forming Flexible Containers with Gussets"; published US patent application 2003/0096068, entitled "One-way valve for inflatable package"; U.S. Pat. No. 4,988,016 entitled "Self-sealing container"; and U.S. Pat. No. 7,207,717, entitled "Package having a fluid actuated closure"; each of which is hereby incorporated by reference. Still further, any of the dispensers disclosed herein, may be incorporated into a flexible container either directly (e.g. formed by one or more flexible materials that are integral with the flexible container), or in combination with one or more other materials or structures (such as a fitment), or in any way known in the art. In some alternate embodiments, dispensers disclosed herein can be configured for both dispensing and filling, to allow filling of product space(s) through one or more dispensers. In other alternate embodiments, a product space can include one or more filling structure(s) (e.g. for adding water to a mixing volume) in addition to or instead of one or more dispenser(s). Any location for a dispenser, disclosed herein can alternatively be used as a location for a filling structure. In some embodiments, a product space can include one or more filling structures in addition to any dispenser(s). And, any location for a dispenser, disclosed herein can alternatively be used as a location for an opening, through which product can be filled and/or dispensed, wherein the opening may be reclosable or non-reclosable, and can be configured in any way known in the art of packaging. For example, an opening can be: a line of weakness, which can be torn open; a zipper seal, which can be pulled open and pressed closed (e.g. a press seal), or opened and closed with a slider; openings with adhesive-based closures; openings with cohesive-based closures; openings with closures having fasteners (e.g. snaps, tin tie, etc.), openings with closures having micro-sized fasteners (e.g. with opposing arrays of interlocking fastening elements, such as hook, loops, and/or other mating elements, etc.), and any other kind of opening for packages or containers, with or without a closure, known in the art.

As used herein, when referring to a flexible container, the term "disposable" refers to a container which, after dispensing a product to an end user, is not configured to be refilled with an additional amount of the product, but is configured to be disposed of (i.e. as waste, compost, and/or recyclable material). Part, parts, or all of any of the embodiments of flexible containers, disclosed herein, can be configured to be disposable.

As used herein, when referring to a flexible container, the term "durable" refers to a container that is reusable more than non-durable containers.

As used herein, when referring to a flexible container, the term "expanded" refers to the state of one or more flexible materials that are configured to be formed into a structural support volume, after the structural support volume is made rigid by one or more expansion materials. An expanded structural support volume has an overall width that is significantly greater than the combined thickness of its one or more flexible materials, before the structural support volume is filled with the one or more expansion materials. Examples of expansion materials include liquids (e.g. water), gases (e.g. compressed air), fluent products, foams (that can expand after being added into a structural support volume), co-reactive materials (that produce gas), or phase change materials (that can be added in solid or liquid form, but which turn into a gas; for example, liquid nitrogen or dry ice), or other suitable materials known in the art, or combinations of any of these (e.g. fluent product and liquid nitrogen). In various embodiments, expansion materials can be added at atmospheric pressure, or added under pressure greater than atmospheric pressure, or added to provide a material change that will increase pressure to something above atmospheric pressure. For any of the embodiments of flexible containers, disclosed herein, its one or more flexible materials can be expanded at various points in time, with respect to its manufacture, sale, and use, including, for example: before or after its product space(s) are filled with fluent product(s), before or after the flexible container is shipped to a seller, and before or after the flexible container is purchased by an end user.

As used herein, when referring to a product space of a flexible container, the term "filled" refers to the state of the product space in the container (which is fully manufactured) after the filling of its product space(s) with fluent product(s) is complete and the container is fully closed and/or sealed, wherein the container has not been opened or unsealed, and wherein the fluent product(s) in the container have not been put into its/their intended end use.

A filled product space may or may not include an allowance for headspace, depending on the kind of fluent product(s) being contained, and the requirements for containing the fluent product(s). As an example, a manufacturer can label a flexible container with an external amount indicium that indicates a listed amount of a fluent product that is being offered for sale with the container, can add to the product space of the container an actual amount of the fluent product that is nearly equal to the listed amount (but still includes a headspace that is designed for that fluent product in that product space), and can close the container so the container is configured for retail sale; that container is considered filled. As used herein, the term filled can be modified by using the term filled with a particular percentage value.

As used herein, the term "flat" refers to a surface that is without significant projections or depressions.

As used herein, the term "flexible container" refers to a container with a product space, wherein one or more flexible materials form 50-100% of the overall surface area of the one or more materials that define the three-dimensional space of the product space. For any of the embodiments of flexible containers, disclosed herein, in various embodiments, the flexible container can be configured to have a product space, wherein one or more flexible materials form a particular percentage of the overall area of the one or more materials that define the three-dimensional space, and the particular percentage is any integer value for percentage between 50% and 100%, or within any range formed by any of these values, such as: 60-100%, or 70-100%, or 80-100%, or 90-100%, etc. One kind of flexible container is a film-based container, which is a flexible container made from one or more flexible materials, which include a film.

For any of the embodiments of flexible containers, disclosed herein, in various embodiments, the middle of the flexible container (apart from any fluent product) can be configured to have an overall middle mass, wherein one or more flexible materials form a particular percentage of the overall middle mass, and the particular percentage is any integer value for percentage between 50% and 100%, or within any range formed by any of the preceding values, such as: 60-100%, or 70-100%, or 80-100%, or 90-100%, etc.

For any of the embodiments of flexible containers, disclosed herein, in various embodiments, the entire flexible container (apart from any fluent product) can be configured to have an overall mass, wherein one or more flexible materials form a particular percentage of the overall mass, and the particular percentage is any integer value for percentage between 50% and 100%, or within any range formed by any of the preceding values, such as: 60-100%, or 70-100%, or 80-100%, or 90-100%, etc.

As used herein, the term "flexible material" refers to a thin, easily deformable, sheet-like material, having a flexibility factor within the range of 1,000-2,500,000 N/m. As examples, a flexible material may have a flexibility factor of 1,000-1,250,500 N/m, 1,000-750,700 N/m, 1,000-500,800 N/m, 1,000-250,900 N/m, 1,000-63,475 N/m, 1,000-25,990 N/m, 1,000-13,495 N/m, 13,495-1,250,500 N/m, 25,990-750,700 N/m, 63,475-500,800 N/m, 125,950-250-900 N/m, 13,495-2,500,000 N/m, 12,990-2,500,000 N/m, 63,475-2,500,000 N/m, 125,950-2,500,000 N/m, 250,900-2,500,000 N/m, 500,800-2,500,000 N/m, 750,700-2,500,000 N/m, 1,250,500-2,500,000 N/m, etc. Examples of materials that can be flexible materials include one or more of any of the following: films (such as plastic films), elastomers, foamed sheets, foils, fabrics (including wovens and nonwovens), biosourced materials, and papers, in any configuration, as separate material(s), or as layer(s) of a laminate, or as part(s) of a composite material, in a microlayered or nanolayered structure, with or without one or more of any suitable additives (such as perfumes, dyes, pigments, particles, agents, actives, fillers (e.g. fibers, reinforcing structures), etc.) and in any combination, as described herein or as known in the art.

The flexible materials used to make the containers disclosed herein can be formed in any manner known in the art, and can be joined together using any kind of joining or sealing method known in the art, including, for example, heat sealing (e.g. conductive sealing, impulse sealing, ultrasonic sealing, etc.), welding, crimping, bonding, adhering, and the like, and combinations of any of these.

As used herein, when referring to a flexible container, the term "flexibility factor" refers to a material parameter for a thin, easily deformable, sheet-like material, wherein the parameter is measured in Newtons per meter, and the flexibility factor is equal to the product of the value for the Young's modulus of the material (measured in Pascals) and the value for the overall thickness of the material (measured in meters).

As used herein, when referring to a flexible container, the term "fluent product" refers to one or more liquids and/or pourable solids, and combinations thereof. Examples of fluent products include one or more of any of the following: bites, bits, creams, chips, chunks, crumbs, crystals, emulsions, flakes, gels, grains, granules, jellies, kibbles, liquid solutions, liquid suspensions, lotions, nuggets, ointments, particles, particulates, pastes, pieces, pills, powders, salves, shreds, sprinkles, and the like, either individually or in any combination. Throughout the present disclosure the terms "fluent product" and "flowable product" are used interchangeably and are intended to have the same meaning. Any of the product spaces disclosed herein can be configured to include one or more of any fluent product disclosed herein, or known in the art, in any combination.

As used herein, when referring to a flexible container, the term "formed" refers to the state of one or more materials that are configured to be formed into a product space, after the product space is provided with its defined three-dimensional space.

As used herein, the term "indirectly connected" refers to a configuration wherein elements are attached to each other with one or more intermediate elements therebetween.

As used herein, the term "joined" refers to a configuration wherein elements are either directly connected or indirectly connected.

As used herein, the term "lateral" refers to a direction, orientation, or measurement that is parallel to a lateral centerline of a container, when the container is standing upright or hanging down from a support, as described herein. A lateral orientation may also be referred to a "horizontal" orientation, and a lateral measurement may also be referred to as a "width."

As used herein, the term "like-numbered" refers to similar alphanumeric labels for corresponding elements, as described below. Like-numbered elements have labels with the same last two digits; for example, one element with a label ending in the digits 20 and another element with a label ending in the digits 20 are like-numbered Like-numbered elements can have labels with a differing first digit, wherein that first digit matches the number for its figure; as an example, an element of FIG. 3 labeled 320 and an element of FIG. 4 labeled 420 are like-numbered Like-numbered elements can have labels with a suffix (i.e. the portion of the label following the dash symbol) that is the same or possibly different (e.g. corresponding with a particular embodiment); for example, a first embodiment of an element in FIG. 3A labeled 320-*a* and a second embodiment of an element in FIG. 3B labeled 320-*b*, are like numbered.

As used herein, the term "longitudinal" refers to a direction, orientation, or measurement that is parallel to a longitudinal centerline of a container, when the container is standing upright on a horizontal support surface or hanging down from a support, as described herein. A longitudinal orientation may also be referred to a "vertical" orientation. When expressed in relation to a horizontal support surface for a container, a longitudinal measurement may also be referred to as a "height", measured above the horizontal support surface.

As used herein, when referring to a flexible container, the term "middle" refers to the portion of the container that is located in between the top of the container and the bottom of the container. As used herein, the term middle can be modified by describing the term middle with reference to a particular percentage value for the top and/or a particular percentage value for the bottom. For any of the embodiments of flexible containers, disclosed herein, a reference to the middle of the container can, in various alternate embodiments, refer to the portion of the container that is located between any particular percentage value for the top, disclosed herein, and/or any particular percentage value for the bottom, disclosed herein, in any combination.

As used herein, the term "nearly" modifies a particular value, by referring to a range equal to the particular value, plus or minus five percent (+/−5%). For any of the embodiments of flexible containers, disclosed herein, any disclosure of a particular value, can, in various alternate embodiments, also be understood as a disclosure of a range equal to approximately that particular value (i.e. +/−5%).

As used herein, when referring to a flexible container, the term "non-durable" refers to a container that is temporarily reusable, or disposable, or single use.

As used herein, when referring to a flexible container, the term "nonstructural panel" refers to a layer of one or more adjacent sheets of flexible material, the layer having an outermost major surface that faces outward, toward the environment outside of the flexible container, and an innermost major surface that faces inward, toward one or more product spaces disposed within the flexible container; a nonstructural panel is configured such that, the layer, does not independently provide substantial support in making the container self-supporting and/or standing upright.

As used herein, the term "product space" refers to an enclosable three-dimensional space that is configured to receive and directly contain one or more fluent product(s), wherein that space is defined by one or more materials that form a barrier that prevents the fluent product(s) from escaping the product space. By directly containing the one or more fluent products, the fluent products come into contact with the materials that form the enclosable three-dimensional space; there is no intermediate material or container, which prevents such contact. Throughout the present disclosure the terms "product space," "product volume," and "product receiving volume" are used interchangeably and are intended to have the same meaning. Any of the embodiments of flexible containers, disclosed herein, can be configured to have any number of product spaces including one product space, two product spaces, three product spaces, four product spaces, five product spaces, six product spaces, or even more product spaces. In some embodiments, one or more product spaces can be enclosed within another product space. Any of the product spaces disclosed herein can have a product space of any size, including from 0.001 liters to 100.0 liters, or any value in increments of 0.001 liters between 0.001 liters and 100.0 liters, or any value in increments of 0.01 liters between 3.0 liters and 10.0 liters, or any value in increments of 1.0 liters between 10.0 liters and 100.0 liters, or within any range formed by any of the preceding values, such as: from 0.001 to 2.2 liters, 0.01 to 2.0 liters, 0.05 to 1.8 liters, 0.1 to 1.6 liters, 0.15 to 1.4 liters, 0.2 to 1.2 liters, 0.25 to 1.0 liters, etc. A product space can have any shape in any orientation. A product space can be included in a container that has a structural support frame, and a product space can be included in a container that does not have a structural support frame.

As used herein, the term "sealed," when referring to a product space, refers to a state of the product space wherein fluent products within the product space are prevented from escaping the product space (e.g. by one or more materials that form a barrier, and by a seal), and the product space is hermetically sealed.

As used herein, the term "squeeze panel" refers to a nonstructural panel that is under tension generated and maintained across the nonstructural panel by one or more structural support volumes, when expanded.

As used herein, when referring to a flexible container, the term "structural support frame" refers to a rigid structure formed of one or more structural support members, joined together, around one or more sizable empty spaces and/or one or more nonstructural panels, and generally used as a major support for the product space(s) in the flexible container and in making the container self-supporting and/or standing upright. In each of the embodiments disclosed herein, when a flexible container includes a structural support frame and one or more product spaces, the structural support frame is considered to be supporting the product spaces of the container, unless otherwise indicated.

As used herein, when referring to a flexible container, the term "structural support member" refers to a rigid, physical structure, which includes one or more expanded structural support volumes, and which is configured to be used in a structural support frame, to carry one or more loads (from the flexible container) across a span. A structure that does not include at least one expanded structural support volume, is not considered to be a structural support member, as used herein.

A structural support member has two defined ends, a middle between the two ends, and an overall length from its one end to its other end. A structural support member can have one or more cross-sectional areas, each of which has an overall width that is less than its overall length.

A structural support member can be configured in various forms. A structural support member can include one, two, three, four, five, six or more structural support volumes, arranged in various ways. For example, a structural support member can be formed by a single structural support volume. As another example, a structural support member can be formed by a plurality of structural support volumes, disposed end to end, in series, wherein, in various embodiments, part, parts, or about all, or approximately all, or substantially all, or nearly all, or all of some or all of the structural support volumes can be partly or fully in contact with each other, partly or fully directly connected to each other, and/or partly or fully joined to each other. As a further example, a structural support member can be formed by a plurality of support volumes disposed side by side, in parallel, wherein, in various embodiments, part, parts, or about all, or approximately all, or substantially all, or nearly all, or all of some or all of the structural support volumes can be partly or fully in contact with each other, partly or fully directly connected to each other, and/or partly or fully joined to each other.

In some embodiments, a structural support member can include a number of different kinds of elements. For example, a structural support member can include one or more structural support volumes along with one or more mechanical reinforcing elements (e.g. braces, collars, connectors, joints, ribs, etc.), which can be made from one or more rigid (e.g. solid) materials.

Structural support members can have various shapes and sizes. Part, parts, or about all, or approximately all, or substantially all, or nearly all, or all of a structural support member can be straight, curved, angled, segmented, or other shapes, or combinations of any of these shapes. Part, parts, or about all, or approximately all, or substantially all, or nearly all, or all of a structural support member can have any suitable cross-sectional shape, such as circular, oval, square, triangular, star-shaped, or modified versions of these shapes, or other shapes, or combinations of any of these shapes. A structural support member can have an overall shape that is tubular, or convex, or concave, along part, parts, or about all, or approximately all, or substantially all, or nearly all, or all of a length. A structural support member can have any suitable cross-sectional area, any suitable overall width, and any suitable overall length. A structural support member can be substantially uniform along part, parts, or about all, or approximately all, or substantially all, or nearly all, or all of its length, or can vary, in any way described herein, along part, parts, or about all, or approximately all, or substantially all, or nearly all, or all of its length. For example, a cross-sectional area of a structural support member can increase or decrease along part, parts, or all of its length. Part, parts, or all of any of the embodiments of structural support members of the present disclosure, can be configured according to any embodiment disclosed herein, including any workable combination of structures, features, materials, and/or connections from any number of any of the embodiments disclosed herein.

As used herein, when referring to a flexible container, the term "structural support volume" refers to a fillable space made from one or more flexible materials, wherein the space is configured to be at least partially filled with one or more expansion materials, which create tension in the one or more flexible materials, and form an expanded structural support volume. One or more expanded structural support volumes can be configured to be included in a structural support member. A structural support volume is distinct from structures configured in other ways, such as: structures without a fillable space (e.g. an open space), structures made from inflexible (e.g. solid) materials, structures with spaces that are not configured to be filled with an expansion material (e.g. an unattached area between adjacent layers in a multilayer panel), and structures with flexible materials that are not configured to be expanded by an expansion material (e.g. a space in a structure that is configured to be a non-structural panel). Notably, in various embodiments, any spaces defined by the unattached area between adjacent layers in a multilayer panel may contain any gas or vapor composition of single or multiple chemistries including air, nitrogen or a gas composition comprising, as examples, greater than 80% nitrogen, greater than 20% carbon dioxide, greater than 10% of a noble gas, less than 15% oxygen; the gas or vapor contained in such spaces may include water vapor at a relative humidity of 0-100%, or any integer percentage value in this range. Throughout the present disclosure the terms "structural support volume" and "expandable chamber" are used interchangeably and are intended to have the same meaning.

In some embodiments, a structural support frame can include a plurality of structural support volumes, wherein some of or all of the structural support volumes are in fluid communication with each other. In other embodiments, a structural support frame can include a plurality of structural support volumes, wherein some of or none of the structural support volumes are in fluid communication with each other. Any of the structural support frames of the present disclosure can be configured to have any kind of fluid communication disclosed herein.

As used herein, the term "substantially" modifies a particular value, by referring to a range equal to the particular value, plus or minus ten percent (+/−10%). For any of the embodiments of flexible containers, disclosed herein, any disclosure of a particular value, can, in various alternate embodiments, also be understood as a disclosure of a range equal to approximately that particular value (i.e. +/−10%).

As used herein, when referring to a flexible container, the term "temporarily reusable" refers to a container which, after dispensing a product to an end user, is configured to be refilled with an additional amount of a product, up to ten times, before the container experiences a failure that renders it unsuitable for receiving, containing, or dispensing the product. As used herein, the term temporarily reusable can be further limited by modifying the number of times that the container can be refilled before the container experiences such a failure. For any of the embodiments of flexible containers, disclosed herein, a reference to temporarily reusable can, in various alternate embodiments, refer to temporarily reusable by refilling up to eight times before failure, by refilling up to six times before failure, by refilling up to four times before failure, or by refilling up to two times before failure, or any integer value for refills between one and ten times before failure. Any of the embodiments of flexible containers, disclosed herein, can be configured to be temporarily reusable, for the number of refills disclosed herein.

As used herein, the term "thickness" refers to a measurement that is parallel to a third centerline of a container, when the container is standing upright or hanging down from a support, as described herein. A thickness may also be referred to as a "depth."

As used herein, when referring to a flexible container, the term "top" refers to the portion of the container that is located in the uppermost 20% of the overall height of the container, that is, from 80-100% of the overall height of the container. As used herein, the term top can be further limited by modifying the term top with a particular percentage value, which is less than 20%. For any of the embodiments of flexible containers, disclosed herein, a reference to the top of the container can, in various alternate embodiments, refer to the top 15% (i.e. from 85-100% of the overall height), the top 10% (i.e. from 90-100% of the overall height), or the top 5% (i.e. from 95-100% of the overall height), or any integer value for percentage between 0% and 20%.

As used herein, when referring to a flexible container, the term "unexpanded" refers to the state of one or more materials that are configured to be formed into a structural support volume, before the structural support volume is made rigid by an expansion material.

As used herein, when referring to a product space of a flexible container, the term "unfilled" refers to the state of the product space when it does not contain a fluent product.

As used herein, when referring to a flexible container, the term "unformed" refers to the state of one or more materials that are configured to be formed into a product space, before the product space is provided with its defined three-dimensional space. For example, an article of manufacture could be a container blank with an unformed product space, wherein sheets of flexible material, with portions joined together, are laying flat against each other.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or patent publication, is hereby incorporated herein by reference in its entirety unless expressly excluded or otherwise limited. The citation of any document is not an admission that it is prior art with respect to any document disclosed or claimed herein or that it alone, or in any combination with any other reference or references, teaches, suggests or discloses any such embodiment. Further, to the extent that any meaning or definition of a term in this document conflicts with any meaning or definition of the same term in a document incorporated by reference, the meaning or definition assigned to that term in this document shall govern.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A disposable flexible container, configured for retail sale, wherein the container comprises:

a product space that directly contains a fluent product, wherein the product space is made from one or more flexible materials;

a film structure that includes:

a first side with a first inner film laminate; and a second side with a second inner film laminate and a second outer film laminate;

an inner unsealed portion between the first inner film laminate and the second inner film laminate, wherein the inner unsealed portion forms a dispenser, and the dispenser is normally closed;

an outer unsealed portion between the second inner film laminate and the second outer film laminate, wherein the outer unsealed portion forms a vent opening for venting a headspace of the product space; and a flow channel in fluid communication with the product volume and the dispenser, wherein about all of the flow channel is made from one or more flexible materials;

wherein, when a squeeze force is applied to the product space the dispenser opens and the container dispenses the fluent product from the product volume, through the flow channel, and out the dispenser.

2. The container of claim 1, wherein the inner unsealed portion automatically returns to its closed condition upon removal of a squeeze force from the product space.

3. The container of claim 1, wherein the inner unsealed portion is normally closed and sealed.

4. The container of claim 1, including one or more dispenser stand-offs disposed between the first inner film laminate and the second inner film laminate at the inner unsealed portion.

5. The container of claim 4, wherein the one or more dispenser stand-offs are disposed on the first inner film laminate at the inner unsealed portion.

6. The container of claim 5, wherein the one or more dispenser stand-offs are embossed onto the first inner film laminate at the inner unsealed portion.

7. The container of claim 4, wherein the one or more dispenser stand-offs are disposed on the second inner film laminate at the inner unsealed portion.

8. The container of claim 7, wherein the one or more dispenser stand-offs are embossed on the second inner film laminate at the inner unsealed portion.

9. The container of claim 4, wherein the one or more dispenser stand-offs are disposed at a distal end of the flow channel, adjacent to the dispenser.

10. The container of claim 4, wherein the one or more dispenser stand-offs are disposed on a laterally central portion of the flow channel.

11. The container of claim 4, wherein the one or more dispenser stand-offs are disposed over substantially all of the flow channel.

12. The container of claim 1, wherein the film structure is a curved film structure, including a curve that extends laterally across the dispenser.

13. The container of claim 1, wherein the vent opening is normally closed, but when a squeeze force is removed from the product space the vent opening opens.

14. The container of claim 1, including one or more vent stand-offs disposed between the second inner film laminate and the second outer film laminate at the outer unsealed portion.

15. The container of claim 14, wherein the one or more vent stand-offs are disposed on the second inner film laminate at the outer unsealed portion.

16. The container of claim 15, wherein the one or more vent stand-offs are embossed on the second inner film laminate at the outer unsealed portion.

17. The container of claim 14, wherein the one or more vent stand-offs are disposed on the second outer film laminate at the outer unsealed portion.

18. The container of claim 17, wherein the one or more vent stand-offs are embossed on the second outer film laminate at the outer unsealed portion.

19. The container of claim 1, wherein the film structure is a curved film structure, including a curve that extends laterally across the vent opening.

* * * * *